US008499527B2

(12) United States Patent
Kobayashi et al.

(10) Patent No.: US 8,499,527 B2
(45) Date of Patent: Aug. 6, 2013

(54) BUILDING CONSTRUCTION METHOD AND ROOM MODULE

(75) Inventors: Kazuaki Kobayashi, Tokyo (JP); Mikio Ishiyama, Tokyo (JP); Naritoshi Idebashi, Tokyo (JP); Shigemi Yasuda, Tokyo (JP); Kiyofusa Shiihashi, Tokyo (JP); Yoshio Serizawa, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 124 days.

(21) Appl. No.: 13/081,537

(22) Filed: Apr. 7, 2011

(65) Prior Publication Data

US 2011/0252718 A1 Oct. 20, 2011

(30) Foreign Application Priority Data

Apr. 15, 2010 (JP) ..... 2010-093873

(51) Int. Cl.
*E04B 1/00* (2006.01)

(52) U.S. Cl.
USPC ..... 52/745.2; 52/79.12; 52/220.2

(58) Field of Classification Search
USPC ..... 52/79.1–79.14, 143, 745.2, 745.19, 52/220.2, 745.02, 745.03, 742.1, 742.13, 52/742.14, 848
See application file for complete search history.

(56) References Cited

U.S. PATENT DOCUMENTS 3,500,595 A * 3/1970 Bennett ..... 52/79.13
4,077,170 A * 3/1978 van der Lely ..... 52/79.1
4,557,099 A * 12/1985 Johnson ..... 52/745.14
4,620,404 A * 11/1986 Rizk ..... 52/602
5,511,908 A * 4/1996 Van Valkenburgh et al. ..... 405/129.55
5,735,639 A * 4/1998 Payne et al. ..... 405/129.57
2008/0276553 A1* 11/2008 Ingjaldsdottir et al. ..... 52/184
2009/0120020 A1* 5/2009 Akagi et al. ..... 52/251
2011/0000146 A1* 1/2011 Takeda et al. ..... 52/79.1
2011/0047889 A1* 3/2011 Gad et al. ..... 52/79.1

FOREIGN PATENT DOCUMENTS

JP 4-293864 10/1992
JP 2003-41661 2/2003

* cited by examiner

*Primary Examiner* — William Gilbert
*Assistant Examiner* — Gisele Ford
(74) *Attorney, Agent, or Firm* — Antonelli, Terry, Stout & Kraus, LLP.

(57) ABSTRACT

The present invention provides a building construction method and a room module which can realize reduction in a construction period in addition to reduction in an on-site working amount by further enlarging a room modularization range. The present invention uses four column members which are vertically provided at inner corners of four room modules adjacent to one another as a frame column of the building when a plurality of room modules are installed in a grid pattern on a floor surface of the building. Specifically, the present invention uses the column member of an angular steel pipe, which the room module has, as the frame column of the building. Thereby, on a construction site, it is not necessary to construct the frame column in advance, and the frame column can be constructed by using the column members of the room module while the room module is installed on the site.

14 Claims, 22 Drawing Sheets

BUILDING CONSTRUCTION METHOD AND ROOM MODULE

BACKGROUND OF THE INVENTION

1. Field of the Invention

The present invention relates to a building construction method and a room module, and particularly relates to a construction method of a building of a nuclear power station or the like, and a room module.

2. Description of the Related Art

In a construction method of a large-scale building of a nuclear power station or the like, a building having a reinforced concrete as a main body with the objectives of maintaining the plant, radiation shielding, and earthquake resistance is constructed on a rigid foundation, and mechatronics equipment and facilities necessary for the power station such as devices, piping, ducts and cables are installed in the building.

However, the method requires a large number of man-hours and a long construction period for construction of a building and on-site installation of mechatronics equipment, and therefore, in order to improve this, Japanese Patent Application Laid-Open No. 4-293864 and Japanese Patent Application Laid-Open No. 2003-41661 propose to introduce room modules of steel-framed structures harmonized with a reinforced concrete structure/steel-framed reinforced concrete structure to achieve enlargement of the factory manufacture range and reduction of the on-site working amount. This is for advancing building construction and mechatronics side by side as part of rationalization of construction.

In the building construction method of Japanese Patent Application Laid-Open No. 4-293864, a modularized product made by installing machine elements to be placed in the room of a nuclear power station building to the prefabricated unit formed by disposing a steel plate inside a steel frame structure is manufactured in a plant in advance as a building module. Subsequently, the building module is installed on a construction site by using a large crane, and concrete is placed by also using the steel plates disposed inside the steel-frame structure as a concrete formwork. Further, the building module is manufactured separately from a frame column of the building.

In the building construction method of Japanese Patent Application Laid-Open No. 2003-41661, a building base portion of a wall structure having a vertical wall as a main body is firstly constructed by applying a reinforced concrete structure, a steel plate concrete structure or the like. Next, at a stage at which the walls of the building base portion corresponding to a certain fixed floor layer are constructed, a composite module which includes a building frame constituted of a floor and columns or walls and devices combined integrally with the building frame, which is manufactured in advance at a place different from the building base portion, is carried in a space partitioned by the aforesaid walls. Next, the building base portion and the composite module are joined to be integrated. Further, the method of Japanese Patent Application Laid-Open No. 2003-41661 uses a steel plate and the like for steel plate concrete for at least part of the building frame, as the building frame constituted of the floor, the support columns or the walls of the composite module.

SUMMARY OF THE INVENTION

However, the building construction method of Japanese Patent Application Laid-Open No. 4-293864 is the method which manufactures a building module separately from the frame column of the building, and installs the module to the building, and therefore, it is difficult to reduce the on-site working amount and shorten the construction period on the building construction side significantly.

Further, the building construction method of Japanese Patent Application Laid-Open No. 2003-41661 has the structure in which the aforesaid composite module is disposed in the building base portion configured by a frame column, a beam, a floor and a wall of a reinforced concrete, and therefore, blocking and modularization of the mechatronics equipment and facilities is restricted, and thus incorporation of the entire physical quantity is limited. More specifically, in the construction method of Japanese Patent Application Laid-Open No. 2003-41661, it is also difficult to reduce the on-site working amount and shorten the construction period significantly as in Japanese Patent Application Laid-Open No. 4-293864.

The present invention is made in view of the above circumstances, and has an object to provide a building construction method and a room module which can shorten the construction period as well as reduce the on-site working amount by further enlarging the range of room modularization, and further can maintain and concentrate entire technical expertise, and can reduce cost.

In order to attain the aforesaid object, the present invention provides a building construction method for constructing a building, comprising: manufacturing, in a plant, rectangular room modules of steel frame structure in which mechatronics equipment are incorporated; transporting the room modules to a building construction site from the plant; and installing the room modules in a grid pattern, with using four column members which are vertically provided at inner corners of adjacent four room modules, as a frame column of the building.

In order to attain the aforesaid object, the present invention provides a room module which is used in the building construction method of the present invention.

As a result of the earnest study on the improvement scheme for solving the problems which Japanese Patent Application Laid-Open No. 4-293864 and Japanese Patent Application Laid-Open No. 2003-41661 have, the inventors of the present application have obtained the following knowledge. That is, the inventors have obtained the knowledge of using the column members of the steel frame which the room module has, as the frame column of the building. Thereby, it is not necessary to construct the frame column on a site, and the frame column can be constructed by using the column members of the room module while the room module is installed on the site.

As above, in the invention of the present application which constructs the frame column of the building during installation of the room module, the range of modularization of the room module is further enlarged by the configuration in which the steel frame is used as the frame column of the building. Hence, reduction in the number of workers and construction period can be achieved by reducing the on-site working amount. Further, enhancement in efficiency and quality maintenance can be realized by securing the in-plant working amount.

In the present invention, it is preferable that concrete is placed in a space in a vertically longer rectangular parallelepiped shape formed by connecting the four column members with steel plates so as to make the frame column of the building have a steel plate concrete structure.

Further, in the present invention, it is preferable that a reinforcing steel is buried in a space in a vertically longer rectangular parallelepiped shape which is formed by connecting the four column members with steel plates and placing concrete in the space so as to make the frame column of the building have a reinforced concrete structure.

According to the present invention, it is preferable that a ceiling and a wall portion of the room module are formed by connecting columns and beams of the room module with lateral beams and vertical column members of steel material, blocking a space between the columns and beams with deck plates or a steel plates so as to form a concrete formwork, and forming a steel plate concrete structure wall or a reinforced concrete structure wall in the ceiling and a space between walls of adjacent room modules.

The ceiling of the room module on which the concrete is placed configures the floor of another room module which is installed on the upper floor of that room module.

According to the present invention, the steel material between the column member and beam member of the room module is a die steel such as an H-shaped die steel, a same plane as the ceiling and a wall surface is configured by the H-shaped die steel or the like, and the H-shaped die steel is used as embedded hardware for fixing a support member which supports the mechatronics equipment, by welding.

In the present invention, the H-shaped steel or the like can be also used as the embedded hardware, and therefore, the support member which supports the mechatronics equipment can be fixed by welding in the plant.

According to the present invention, it is preferable that when an upper floor layer is constructed by installing, on a lower floor layer of the building, a room module having a same configuration as a plurality of room modules constituting the lower floor layer, a lower portion of the column member of the room module on the upper floor layer and an upper portion of the column member of the room module on the lower floor layer are joined by welding.

Further, the room module which has a ceiling of steel plate concrete structure and devices installed as a wall may be adopted. Concrete can be placed and charged in a partition wall and an intermediate ceiling portion in the room module, in the plant.

The members configuring the room module are given strength enough to sufficiently stand a self weight of mechatronics equipment which is placed in the room module and a load applied during transportation from the plant to a construction site, and thereby, many temporary steel members which are used in the conventional device module can be significantly reduced. The holes, lugs and the like for mounting a temporary joint beam, a suspension hardware and a transportation material are placed on the members configuring the above in the plant.

In the room module, standardization of the structure and the standardization of the manufacturing method are facilitated by using the building reference line and the floor height dimension as the reference.

When the frame of the room module is manufactured in the plant, manufacturing efficiency and precision can be enhanced by using the variable manufacture jig. For example, in the ceiling portion manufacturing, downward work is substantially always enabled by transpose (dislocation) and inversion by a jig or a crane.

In mounting of the support members and the like which support the devices and the mechatronics equipment such as piping which are placed on the ceiling portion, downward mounting is enabled for substantially all of them, and upward welding, scaffolding work and the like in the conventional work for the ceiling portion on a construction site can be reduced, so that enhancement of working efficiency and quality maintenance can be realized.

In the in-plant manufacture of the frames of the room module, machine finish is performed for the space between the floor surfaces including the finishing allowance and the height adjustment allowance after completion of main welding, and on the site, the column end portions are welded after centering is performed for the room module by using a guide. Therefore, as compared with the conventional building tolerance, the present invention can provide the frame with much higher precision.

The frame of the room module is made with high precision, and therefore, the support members which support the mechatronics equipment can be mounted as designed. In contrast with this, in the conventional equipment module, many of the frames are temporarily set in consideration of the frame dimension error at the time of installation, a finishing error and an equipment installation position error, and therefore, the support members cannot be mounted as designed. Accordingly, as compared with the conventional installation method of the building construction frame and mechatronics equipment on a site, quality can be ensured and production with high efficiency can be realized.

In the room module, as to the foundation portion of the main equipment, a beam, an anchor or the like with the necessary strength is mounted to the rectangular steel frame in accordance with the floor level, and the reinforcing steel, the anchor bolts and the formwork are set in the plant. Further, as to a compact foundation, concrete can be placed and charged in the plant.

By shipping the in-plant manufactured room modules with which the components applied on a site is packaged, the on-site storage space, and storage management work can be significantly reduced.

In the area with long equipment and piping, a room module can be configured by connecting a plurality of room modules.

According to the building construction method, the room module, and the standardized design of the facilities of the present invention, the following effects can be further obtained.

a) Enlargement and sophistication of the room module can be realized, and modularization rate can be enhanced.

b) Due to high precision as compared with a concrete frame, a tight module as designed is obtained.

c) Reduction in the number of workers and the construction period can be realized by reduction in the on-site working amount.

d) By reduction in the on-site working amount, simplification of infrastructures and management of local constructors can be realized in foreign countries.

e) By enhancement in precision, the on-site adjustment operation can be significantly reduced.

f) In the on-site product management, the management operation of component receiving, storage, delivery, on-premises transportation and the like can be significantly reduced. Enhancement in efficiency and quality maintenance are realized by securing the in-plant working amount.

g) In-plant manufacture achieves highly efficient production and quality maintenance, and the core technology can be inherited.

h) The equipment and facilities can be designed without being influenced by error in a finished dimension of the concrete building, and reduction in the design cost can be realized.

DETAILED DESCRIPTION OF THE PREFERRED EMBODIMENTS

Hereinafter, a preferred embodiment of a building construction method and a room module according to the present invention will be described in accordance with the accompanying drawings.

Figure 1:
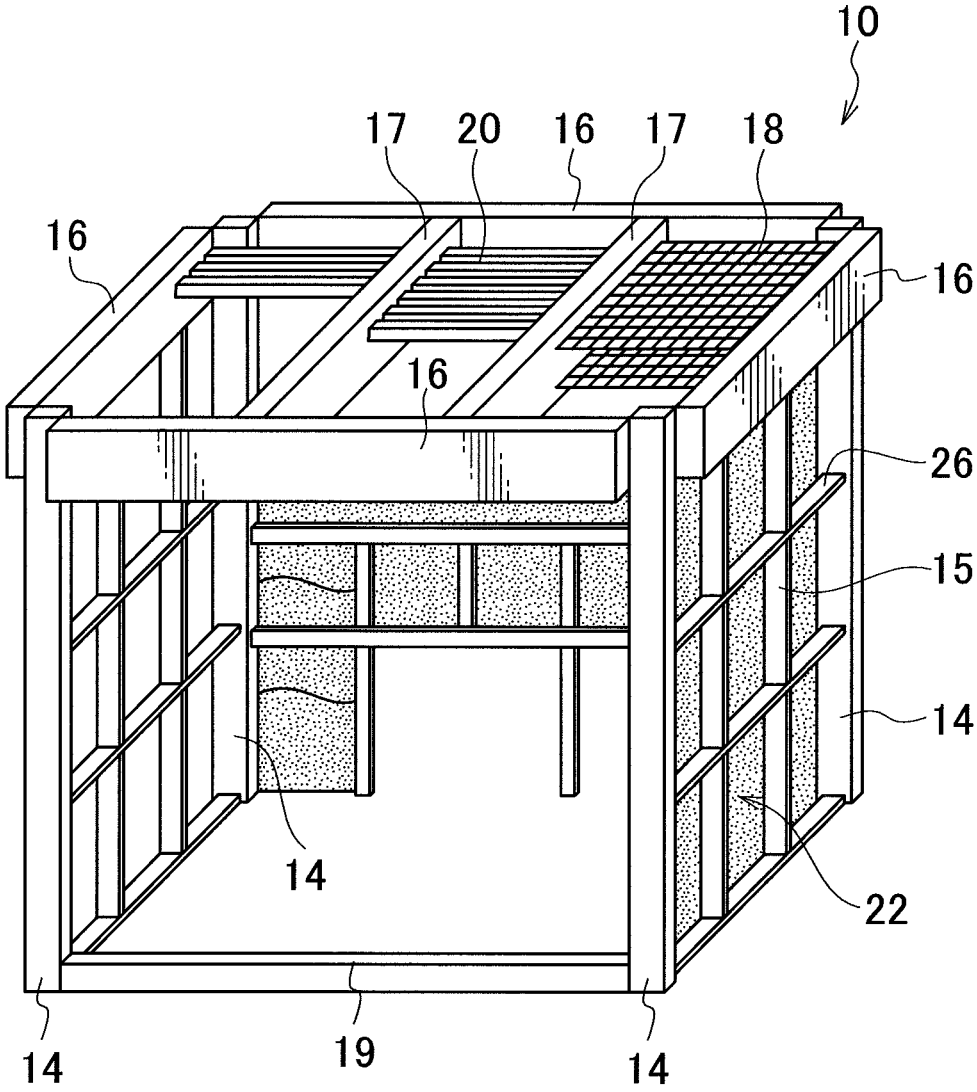
FIG. 1 is a general perspective view showing a room module of an embodiment.

FIG. 1 is a general perspective view showing a rectangular room module 10 of the embodiment. The room module 10 is configured as a module for constructing a nuclear power station building, but the building to be constructed is not limited to a nuclear power station, and the room module 10 can be applied to any large-scale buildings such as a thermal power station. In FIG. 1, mechatronics facilities which are incorporated into the room module 10 are omitted.

The room module 10 shown in FIG. 1 is manufactured by being assembled in a manufacturing plant of room modules. As the precondition, necessary change of the conventional building size, apparatus layout and the like is minimized, and the column members and beams are made as a steel frame to facilitate room modularization.

Figure 2:
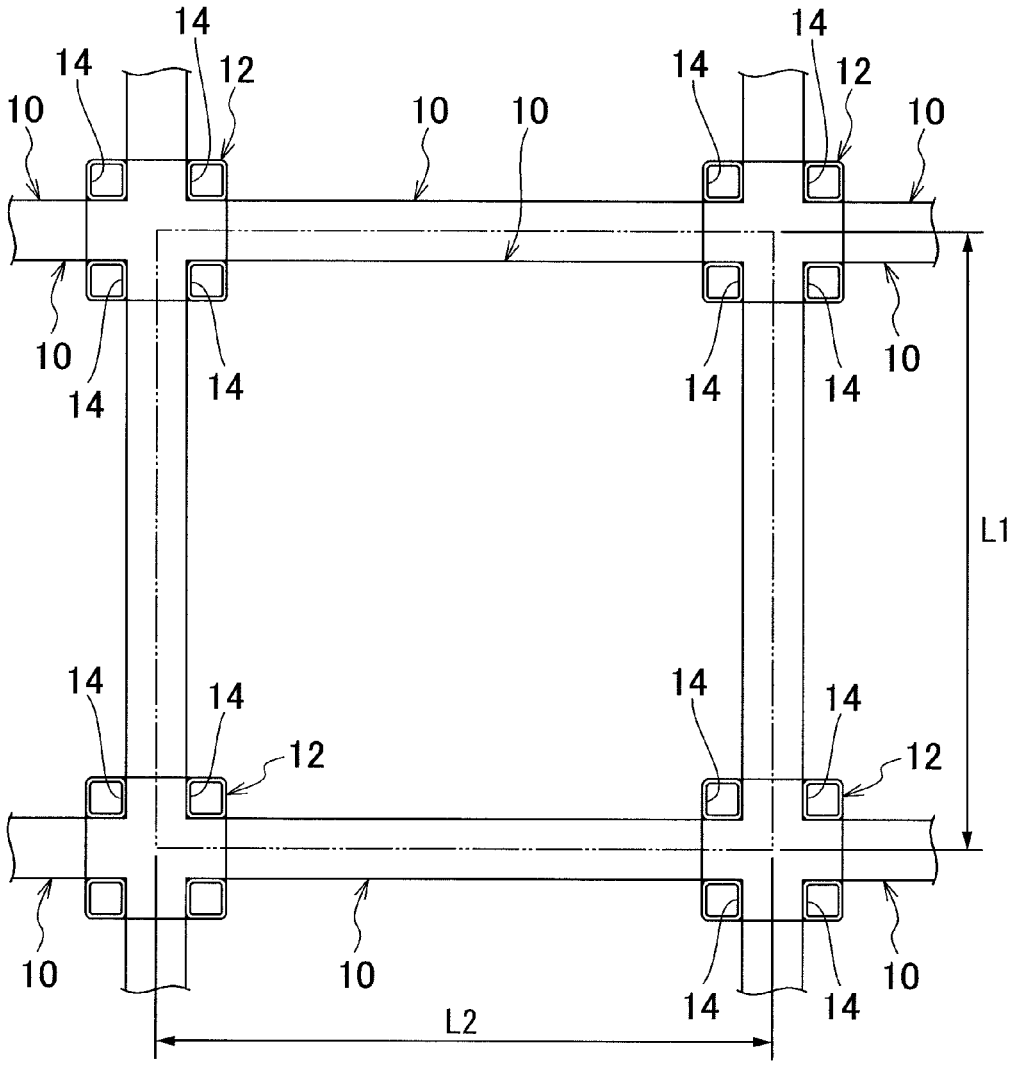
FIG. 2 is a plane view of the room module and an explanatory view showing a relationship with a frame column.
Figure 3:
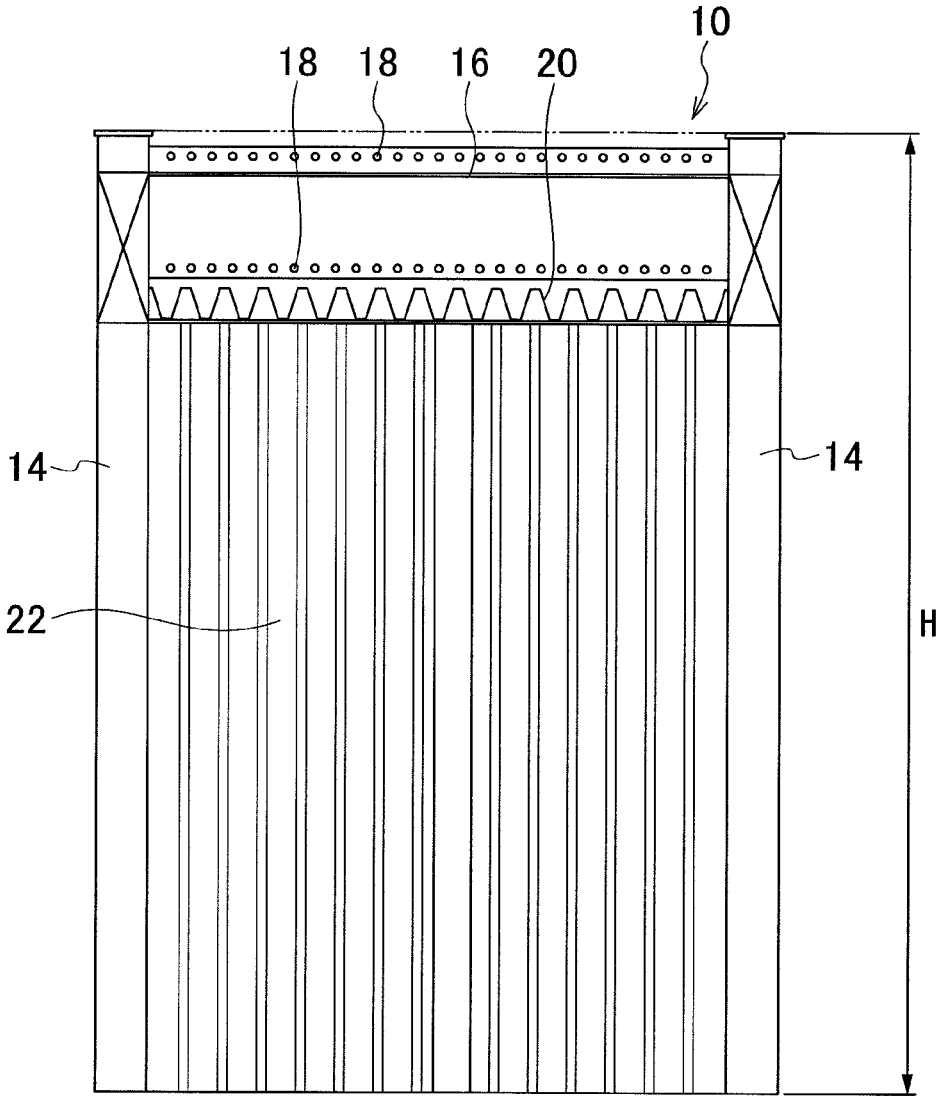
FIG. 3 is a side view of the room module.

In the room module 10, as shown in the plane view of FIG. 2, the internal dimensions of rectangular steel frame are determined by dimensions obtained by subtracting a half of an outer dimension of a frame column 12 of the present building from reference line dimensions L1 and L2 of the building. Further, a height H of the room module 10 is set as a dimension between floor surfaces as shown in FIG. 3. The maximum mass of the room module 10 including mechatronics equipment is determined in view of plant manufacturing, transportation and installation.

As shown in the assembly procedure shown in FIGS. 4A to 4E, in the room module 10, angular steel pipes and the like are used as well as four column members 14, a plurality of beams 16 and temporary joint beams 19. Further, as auxiliary members which are used as a lateral beam 17 and a vertical column member 15, an H-shaped steel and an L-shaped steel are arranged. Outer dimensions of these steel members are adjusted to the building dimensions, and the dimensions are selected in accordance with a load, the span, height and the like. More specifically, the yield of the row material is considered.

Further, at the time of construction of a steel frame, a variable standard jig is used to enhance the manufacture efficiency and precision. Machining is carried out for the space between the floor surfaces after completion of main welding.

The column members 14 and the beams 16 which configure the room module 10 are formed into a rectangular steel frame, and thereby, the use amount of a reinforcing steel 18 placed in the ceiling is minimized. The reinforcing steel 18 which is used for the ceiling and the walls is prefabricated in accordance with the places and is fixed to the formwork of deck plates 20 or the like which is placed on the ceiling and the walls and the formwork of steel plates 22 or the like which is placed on the walls. For the ceiling and the walls, the deck plates 20 or the steel plates 22 are used, and formworks are not used. By placing concrete on the ceiling of the room module 10, the floor surface of the room module 10 which is installed on the upper floor of it is constructed.

Figure 4A:
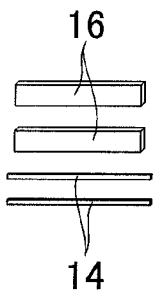
FIGS. 4A to 4E are explanatory views showing an assembly procedure of the room module.
Figure 4B:
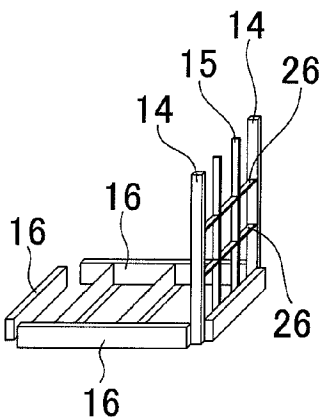
Figure 4C:
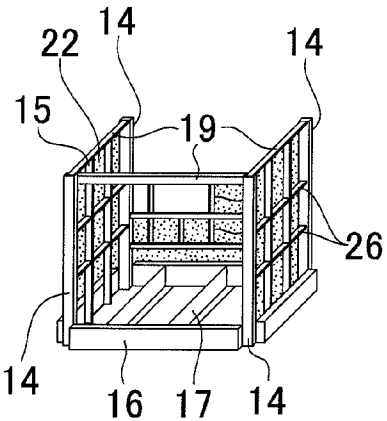
Figure 4D:
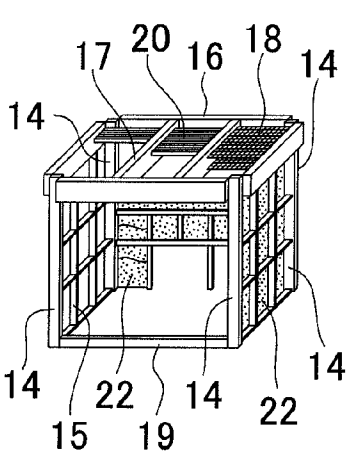
Figure 5:
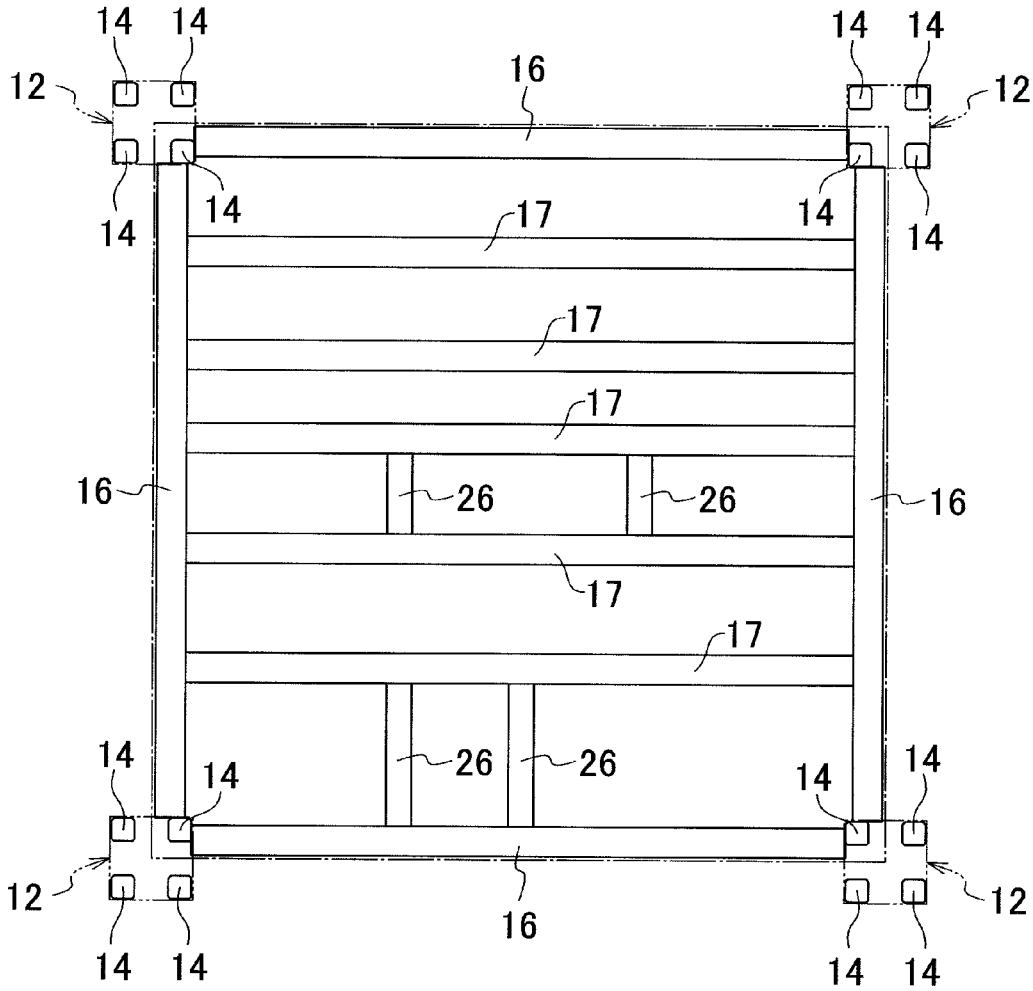
FIG. 5 is a plane view of a ceiling frame showing a ceiling frame structure of the room module.
Figure 6:
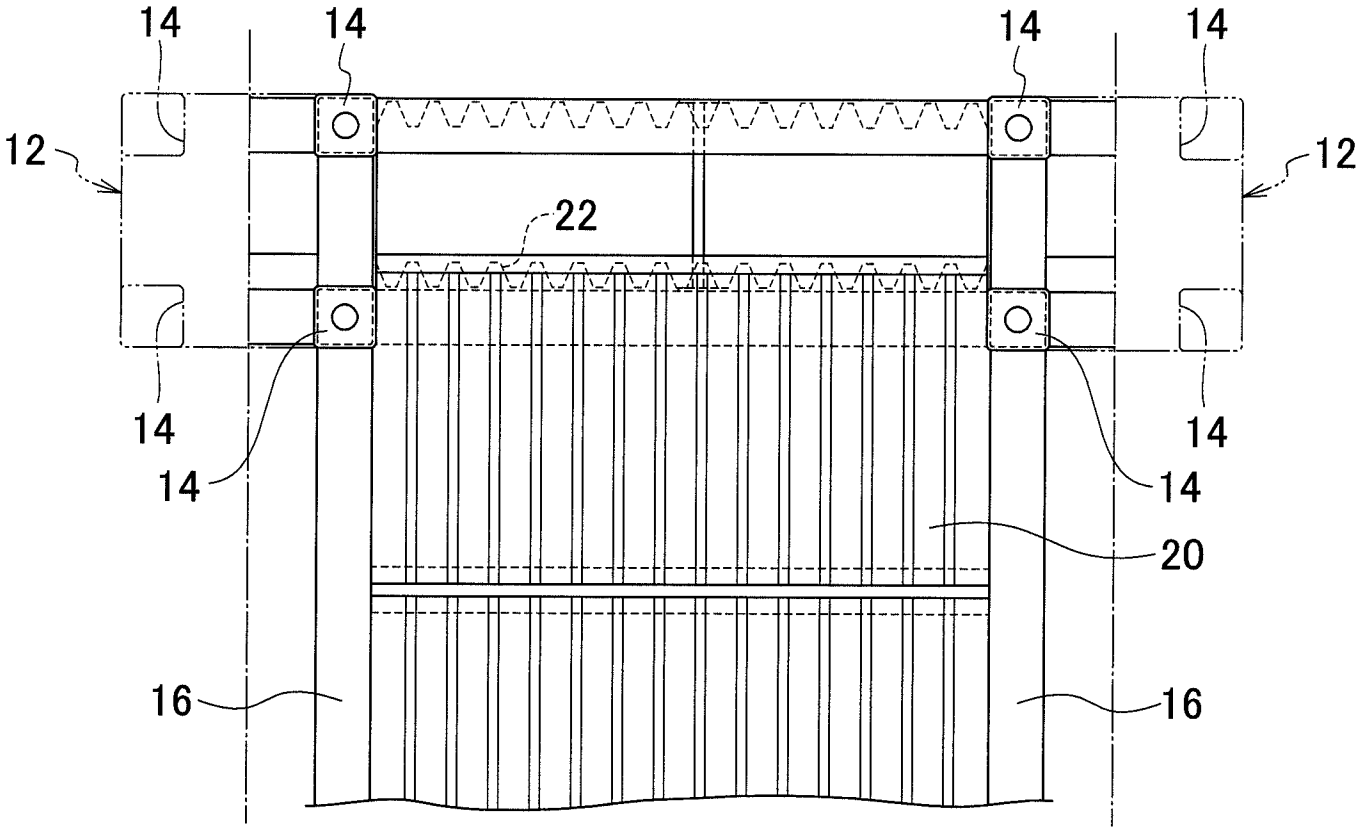
FIG. 6 is a plane view showing a deck plate of the ceiling frame of the room module.

In FIGS. 4B and 4C, the beams 16 which configure the ceiling of the room module 10 are fitted first. Further, a plurality of lateral beams 17 and a plurality of small beams 26 are properly welded to the ceiling frame which is configured by the beams 16 as in a plane view of FIG. 5, and thereby, the ceiling is reinforced. Next, the four column members 14 are fitted to four corners of the ceiling frame, after which, a plurality of vertical column members 15 and steel plates 22 are fitted to between the column members 14, and the temporary joint beams 19 for securing the strength of the room module 10 in the construction process are placed as shown in FIG. 4C. Next, the room module is turned upside down as in FIG. 4D to be returned to the normal state, and the deck plates 20 are fitted to the ceiling frame as in the plane view of FIG. 6, while the reinforcing steel 18 is fitted onto the ceiling frame as shown in FIG. 4D. Thereafter, the mechatronics equipment such as piping 24 is fitted to the room module 10 as in FIG. 4E. Thereby, the room module 10 is completed.

In the room module 10 of the embodiment, the embedded hardware exclusive for the support member which supports the piping 24 or the like is not used, and the rectangular steel frame which configures the column members 14, the walls, the ceiling and the floor is used as the embedded hardware. This will be described later. In the conventional room module, the exclusive embedded hardware is used by being passed through the same plane of the room module 10, but in the room module 10 of the embodiment, exclusive embedded hardware is not used as much as possible. Further, buried members such as a floor drain and funnel are incorporated on the deck plate 20 and the reinforcing steel 18 of the ceiling in the plant. The temporary joint beam 19 is for preventing deformation of the room module 10 due to the piping 24 or the like, and can be mounted in accordance with necessity.

Figure 4E:
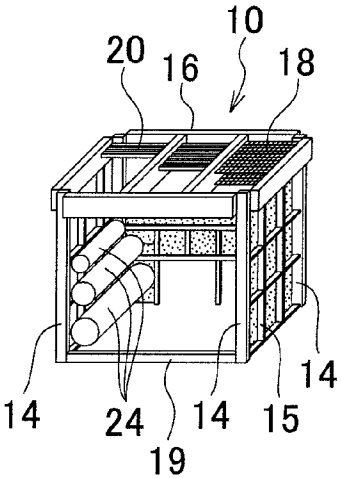
Figure 7:
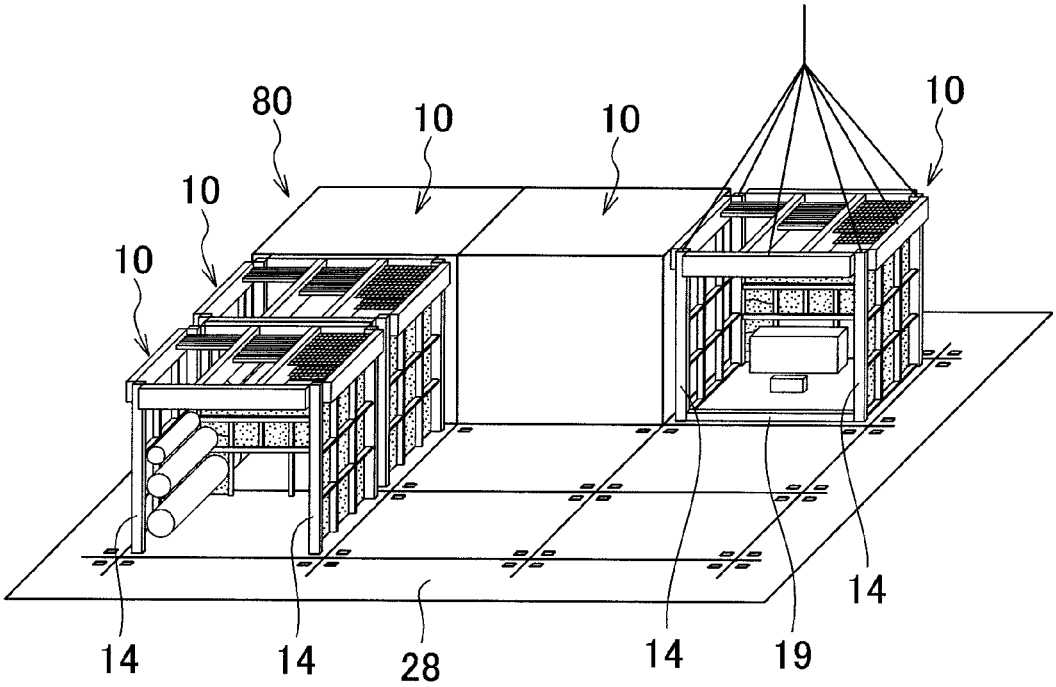
FIG. 7 is a perspective view showing a construction example of a first floor portion of a nuclear power station building.
Figure 8:
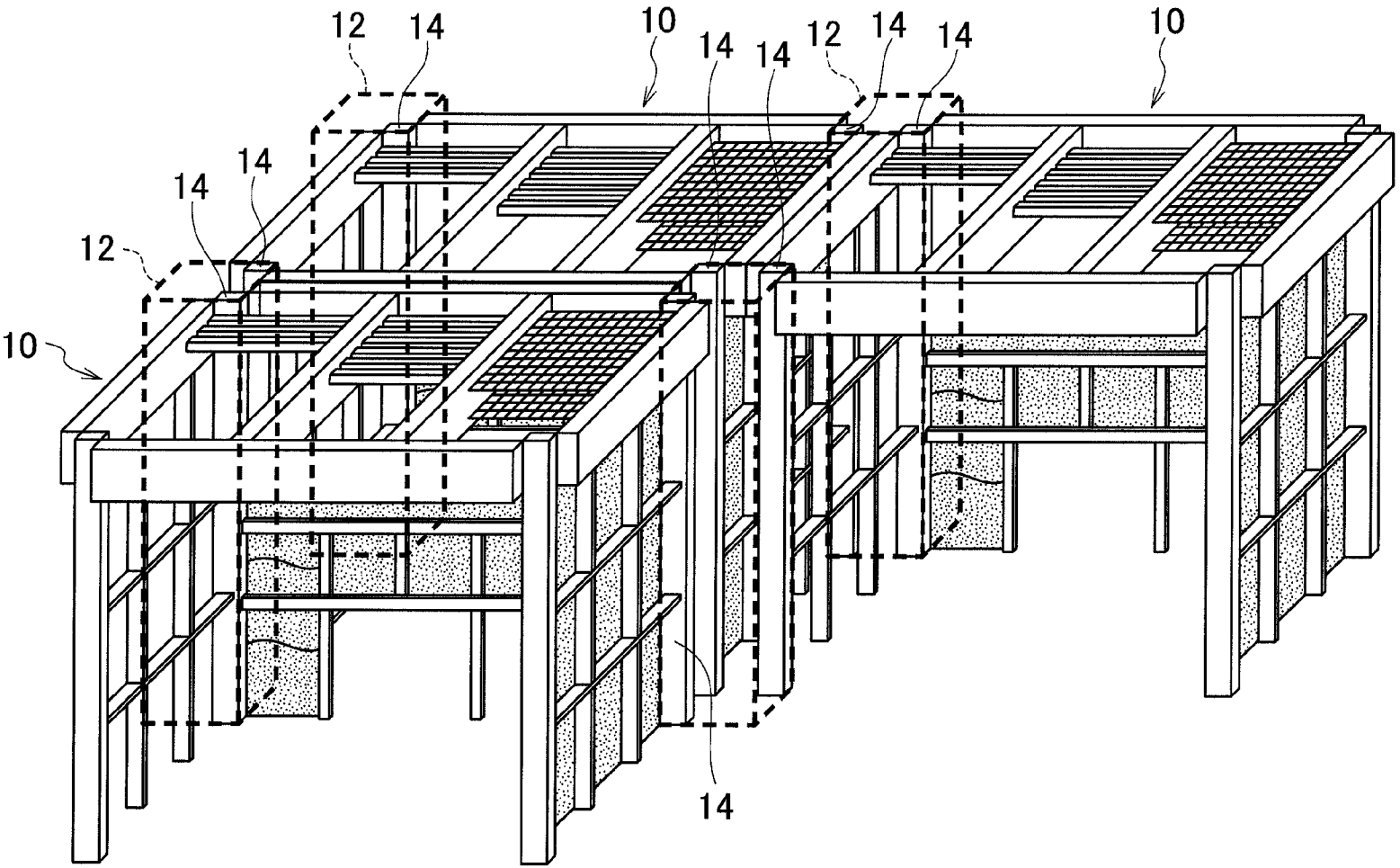
FIG. 8 is a perspective view showing an arrangement relation of the room modules configuring the frame columns.

The building construction method of the embodiment is the method for constructing the building by manufacturing the rectangular room module 10 of the steel frame structure with the mechatronics equipment incorporated therein shown in FIG. 4E in a plant, transporting the room module 10 to the building construction site from the plant and installing the room module 10. The main feature is to use the four column members 14 which are vertically provided at the inner corners of the four room modules 10 (the adjacent three room modules 10 are shown in FIG. 8) which are adjacent to one another as the frame columns 12 (refer to FIG. 2 or the like) as shown in a perspective view of FIG. 8, when a plurality of room modules 10 are installed in a grid pattern on the floor surface (foundation surface) 28 of the building as shown in FIG. 7.

More specifically, the building construction method of the embodiment uses the column members 14 of an angular steel pipe which the room module 10 has as the frame column 12 of the building. Thereby, it is not necessary to construct the frame column 12 in advance on the construction site, and the frame column 12 can be constructed by using the column members 14 of the room module 10 while the room module 10 is installed on the construction site.

As above, in the building construction method of the embodiment which constructs the frame column 12 of the building with installation of the room module 10, by the configuration which uses the column member 14 of the angular steel pipe as the frame column 12 of the building, the range of modularization of the room module 10 is enlarged as compared with the conventional module. Therefore, reduction in the number of workers and reduction in the construction period by reduction of the on-site working amount can be realized. Further, enhancement in efficiency and quality maintenance can be realized by securing the plant working amount. The temporary joint beam 19 is removed at the stage at which the room module 10 is disposed at a predetermined position.

The construction-relating members which configure the room module 10 include the steel members (die steels) 15 and 17 between the column members 14 and the beams 16, the formwork member by the deck plate 20 or the steel plate 22, the reinforcing steel 18, stud dowel and the like. Further, the mechatronics equipment mounted to the room module 10 includes the piping 24, valves, ducts, cable trays, support structures (support members) and the like. Further, the members which are installed on the side wall and the ceiling wall of the room module include a floor penetration sleeve, embedded hardware, device anchor bolts, electrical conduits, a junction box, lighting equipment, an operation stand, a monorail and the like. The mass of the room module 10 is determined by these members, and therefore, the maximum mass of the room module is determined in view of plant manufacturing, transportation and installation.

The buried piping such as an electrical conduit and air piping as well as the junction box is preferably mounted inside the deck plate 20. Further, it is preferred that in the wall penetration portion for burying a sleeve for the piping 24, the air-conditioner duct, the wiring duct and the like, a sleeve having a length ranging from ½ to minus 50 mm (−50 mm) of the wall thickness of the wall penetrating portion is fixed to the deck plate 20 or the steel plate 22 from the inner surface of the rectangular steel frame. At this time, a strutting member for the sleeve tip end and an outer casing for connection are preferably attached. As to the ceiling penetration portion, a sleeve of a length corresponding to the length from the top surface in the rectangular steel frame to the floor is preferably fixed to the deck plate 20.

Figure 9:
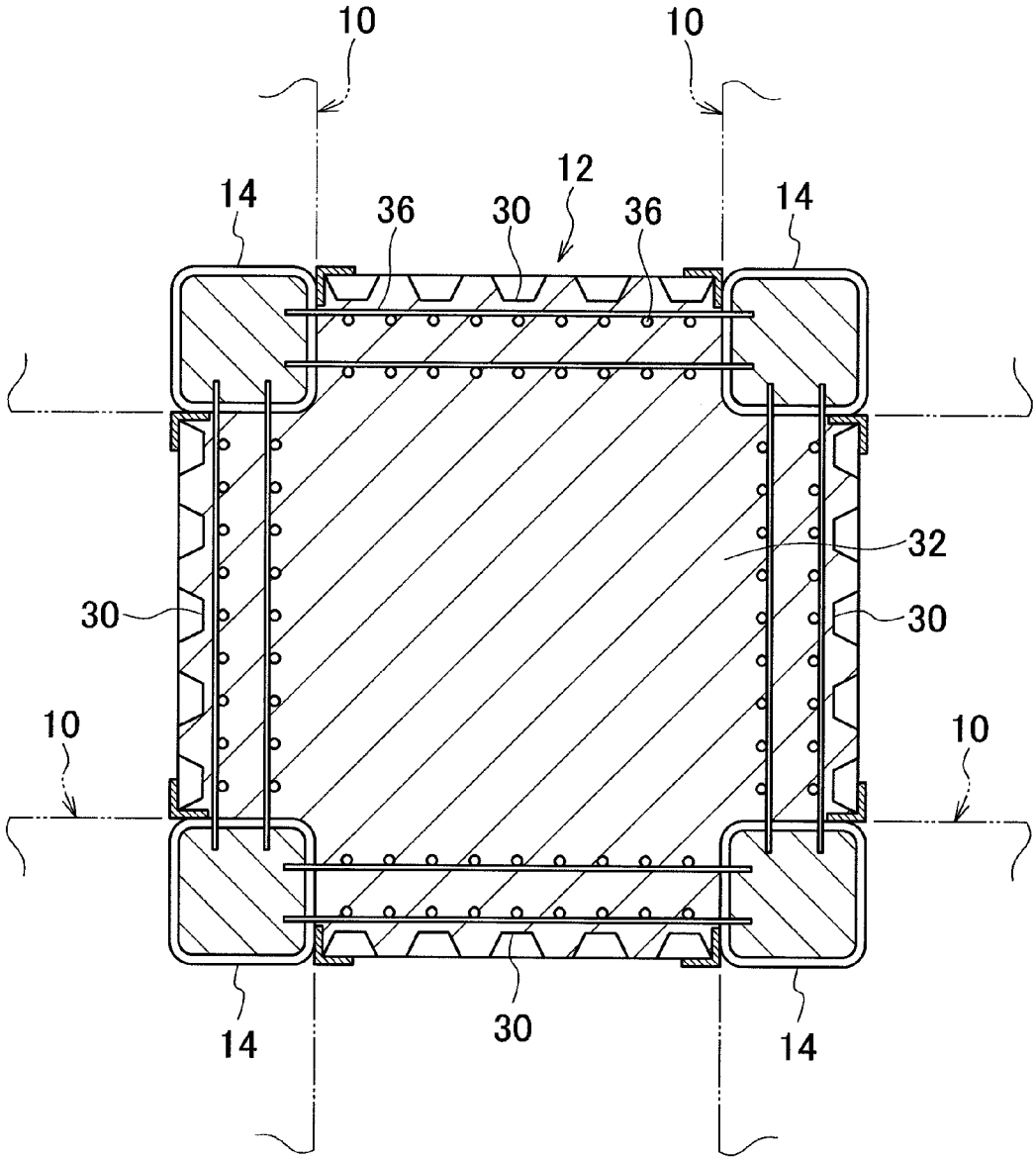
FIG. 9 is a sectional view in a horizontal direction showing a first mode of a structure of the frame column.

Incidentally, a first mode for completing the frame column 12 constructs the frame column 12 of the building by connecting the four column members 14 by steel plates 30 such as deck plates, burying reinforcing steels 36 in a space in the vertically longer rectangular parallelepiped shape enclosed by the column members 14 and the steel plates 30, and thereafter, placing a concrete 32, as in the horizontal sectional view of the frame column 12 shown in FIG. 9. More specifically, the frame column 12 is formed into a reinforced concrete structure (RC structure) having the column members 14. In this case, in the column members 14 and the beams 16 facing the surfaces of the reference lines which are charged with the concrete 32, holes are bored on the abutment surface on the concrete 32 to pass through the reinforcing steels 36.

Figure 10:
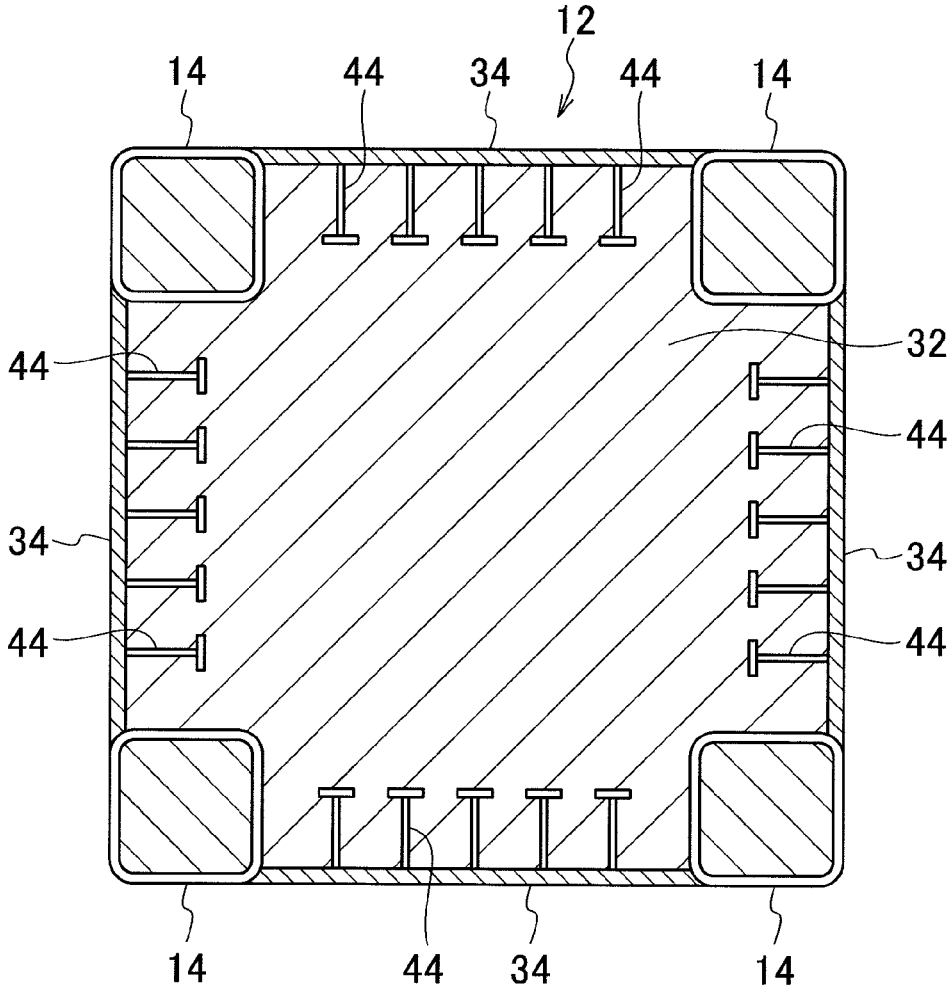
FIG. 10 is a sectional view in the horizontal direction showing a second mode of the structure of the frame column.

Further, in a second mode for completing the frame column 12, the frame column 12 of the building is constructed by connecting four column members 14 by steel plates 34 which are provided with stud dowels 44 on inner sides thereof, and placing the concrete 32 in a space in a vertically longer rectangular parallelepiped shape enclosed by the four column members 14 and the steel plates 34, as shown in a horizontal sectional view of the frame column 12 shown in FIG. 10. More specifically, the frame column 12 is formed into a steel plate concrete structure (SC structure) having the column members 14.

More specifically, the embodiment is the method for constructing a building by manufacturing, in a plant, the room module 10 in which the mechatronics equipment and facilities are mounted in the space enclosed by the building reference lines with steel members (die steels) embedded in the column members and beams of the reinforced concrete structure or the steel plate concrete structure as the frame, and placing and charging the concrete 32 after transportation and on-site installation.

Figure 11:
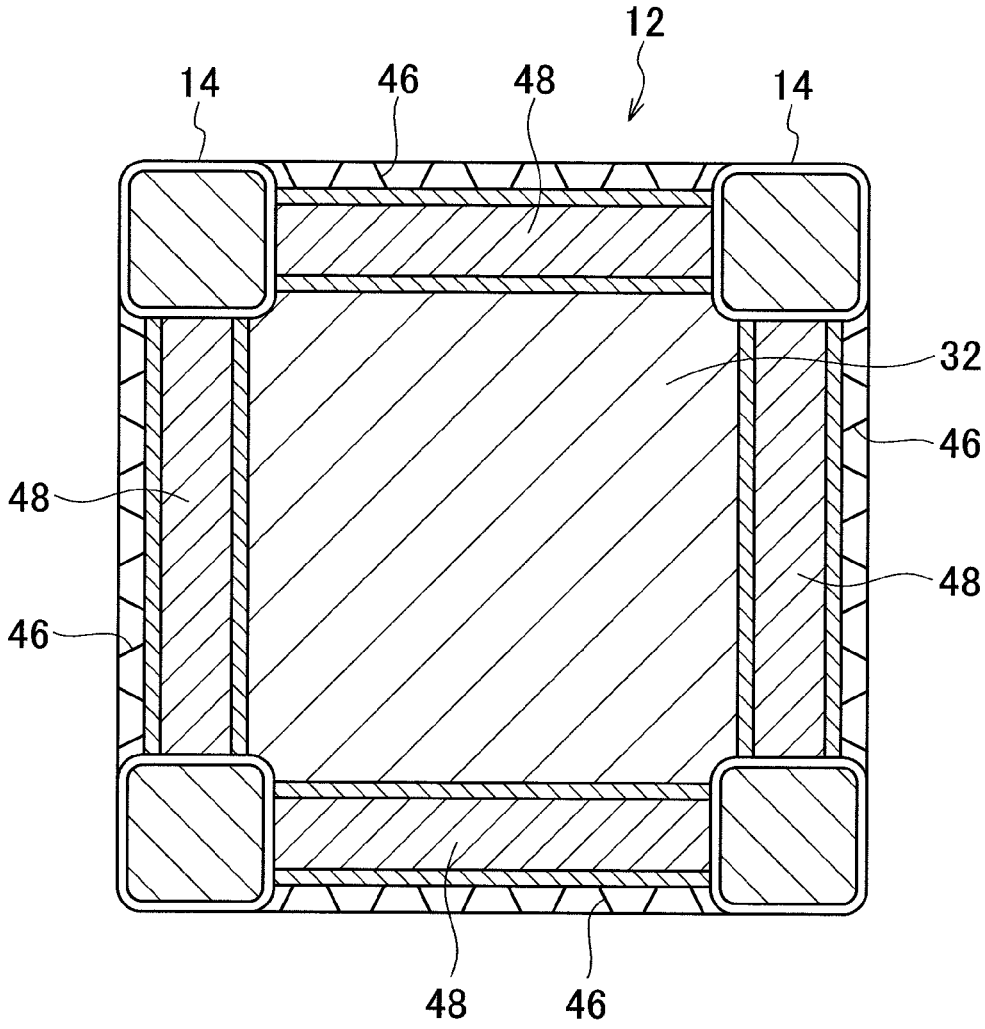
FIG. 11 is a sectional view in the horizontal direction showing a third mode of the structure of the frame column.

The structure of the frame column 12 is not limited to the aforementioned first and second modes. For example, as shown in FIG. 11, the structure may be adopted, in which the four column members 14 are connected by deck plates 46 and steel members 48, and the concrete 32 is placed in a space enclosed by the four column members 14, the deck plates 46 and the steel members 48. More specifically, the structure using the four column members 14 as the frame column 12 can be adopted. Further, the column member 14 may be a steel member with an L-shaped section. More specifically, the shape of the column member 14 is not limited as long as the necessary strength can be obtained as the entire frame column 12.

Meanwhile, according to the building construction method using the room module 10, it is preferable that in the ceiling and the wall portion of the room module 10, the column members 14 and the beams 16 of the room module 10 are connected by the lateral beams 17 of the steel material and the vertical column member 15, and the space between the lateral beams 17 and the vertical column members 15 are blocked with the deck plates 20 or the steel plates 22 to form a concrete formwork, and the ceiling and the spaces from the walls of the adjacent room modules are formed to be steel plate concrete structure walls or a reinforced concrete structure wall.

The ceiling of the room module 10 in which the concrete is placed configures the floor of another room module 10 which is installed on the upper floor of this room module 10. Setting of the main device foundation portion which constitutes a floor of the room module 10 is preferably performed by mounting a beam, an anchor or the like with the required strength to the room module 10 in accordance with the floor level.

Furthermore, according to the building construction method of the embodiment, the steel members (the lateral beams 17, the vertical column members 15) between the column members 14 and the beam members 16 of the room module 10 are die steels, and it is preferable that by the die steels, the same planes as the ceiling and the wall surface are configured and that the aforesaid die steels are used as the embedded hardware for fixing the support member which supports the mechatronics equipment, by welding.

Figure 12:
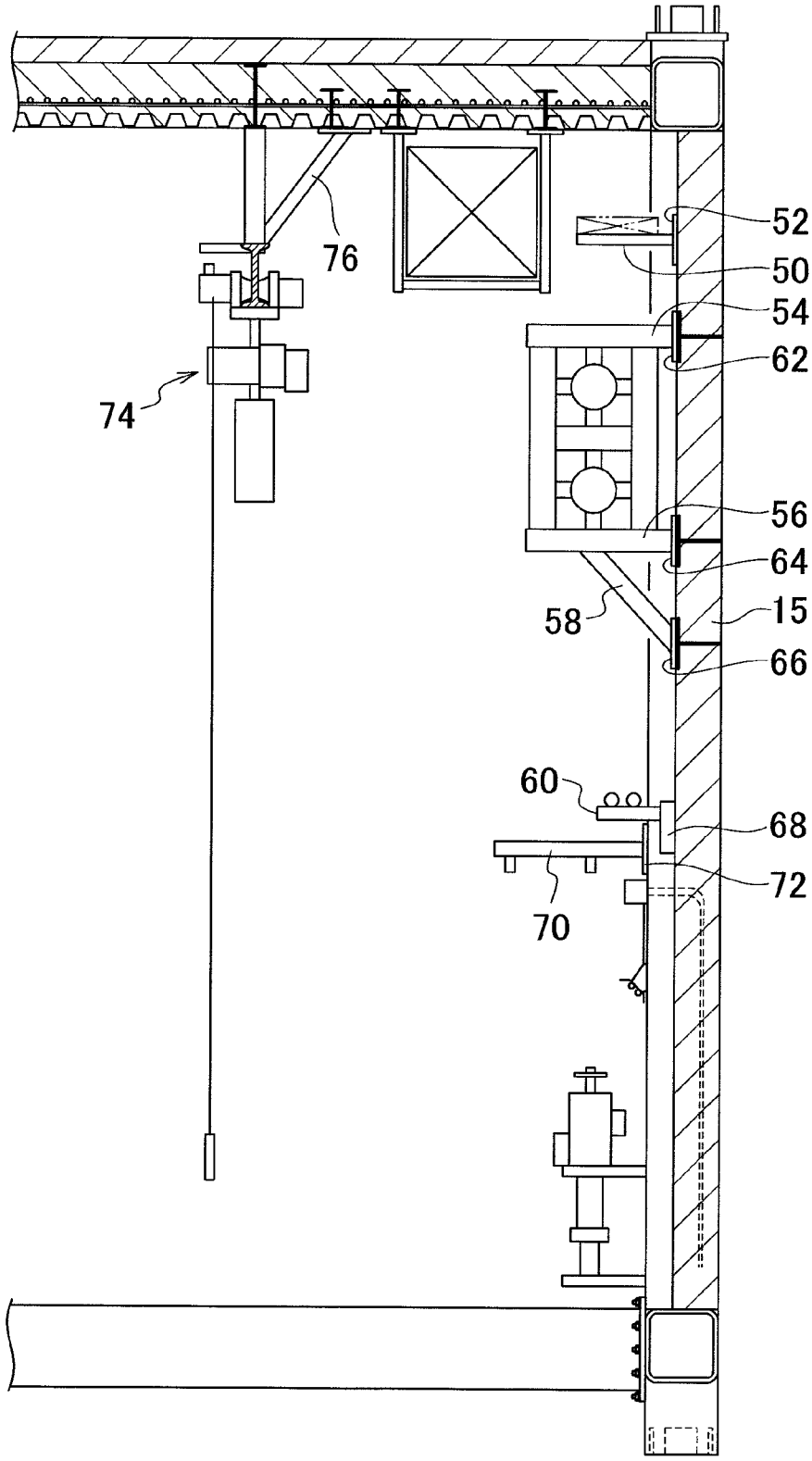
FIG. 12 is an explanatory view of a structure in which an H-shaped steel member is also used as embedded hardware.

FIG. 12 shows one example of the method. According to FIG. 12, the vertical column member 15 is used as the embedded hardware, to the vertical column member 15, a cable support member 50 is fixed via a steel plate 52, piping support members 54, 56, 58 and 60 are fixed via steel plates 62, 64, 66 and 68, a valve suspension support member 70 is fixed via a steel plate 72. The steel plates 52, 62, 64, 66, 68 and 72 may be fixed to the vertical column member 15 by using fixing members such as bolts, or may be fixed by welding. Further, a support member 76 of a monorail 74 is fixed to the lateral beam 17 of the ceiling via a steel plate 78.

According to the method, the H-shaped steel and the like with high strength can be concurrently used as embedded hardware, and therefore, the number of pieces of embedded hardware of the room module 10 can be reduced. Further, the room module having a ceiling of the steel plate concrete structure and devices installed as walls may be adopted. Concrete can be placed and charged in them in the partition walls and the intermediate ceiling portion in the room module, in a plant.

Figure 13:
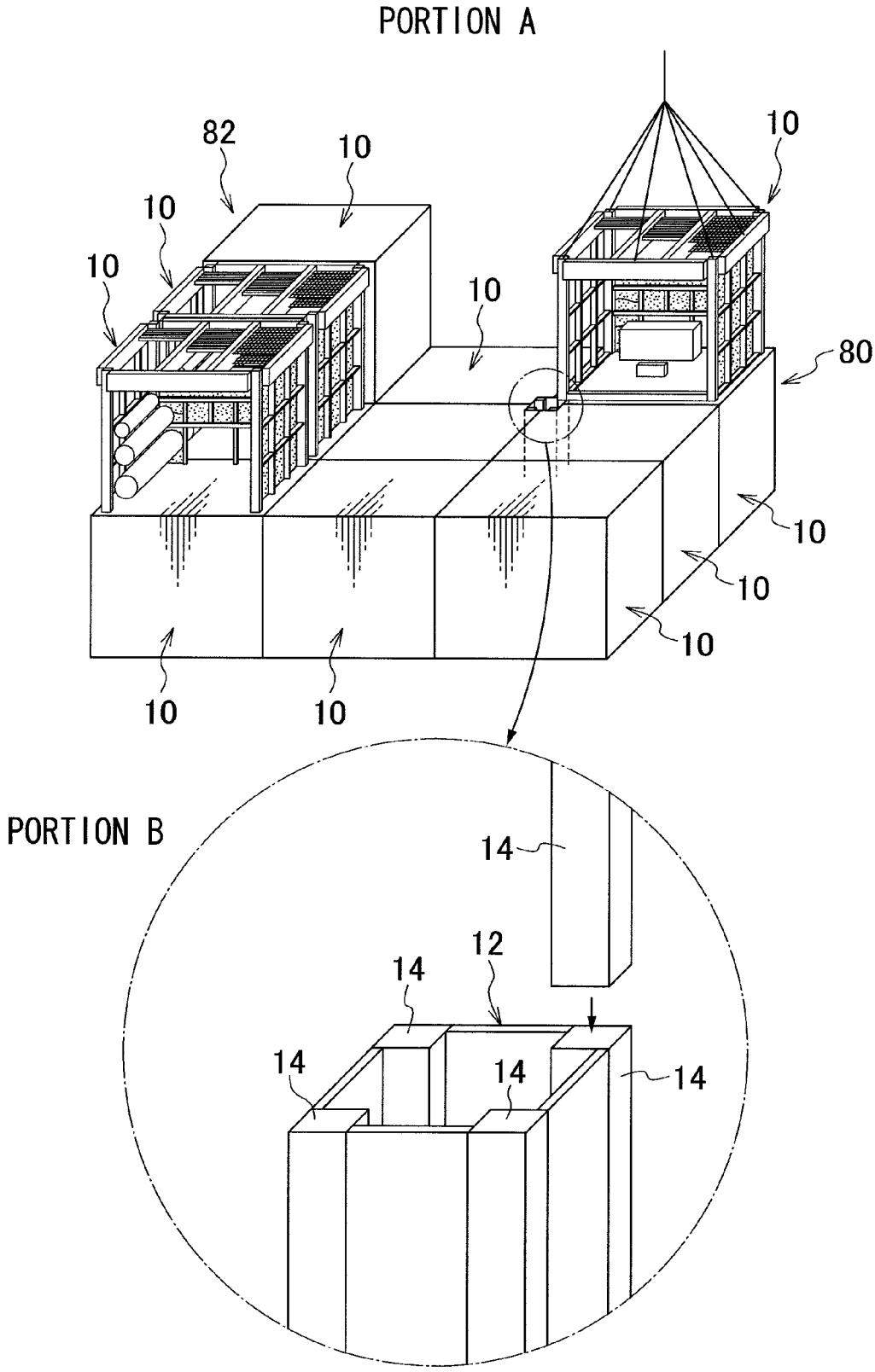
FIG. 13 is a perspective view showing a connection structure of frame columns of a lower floor and an upper floor.

Furthermore, according to the building construction method of the embodiment, on a lower floor 80 of the building constituted of a plurality of room modules 10 which are installed on a lower floor, room modules 10 of the same configuration are installed to construct an upper floor 82, as shown in Portion A of FIG. 13. In this case, the lower portions of the column members 14 of the room modules 10 on the upper floor 82 and the upper portions of the column members 14 of the room modules 10 on the lower floor 80 are preferably joined by welding as shown in Portion B of FIG. 13.

Figure 14:
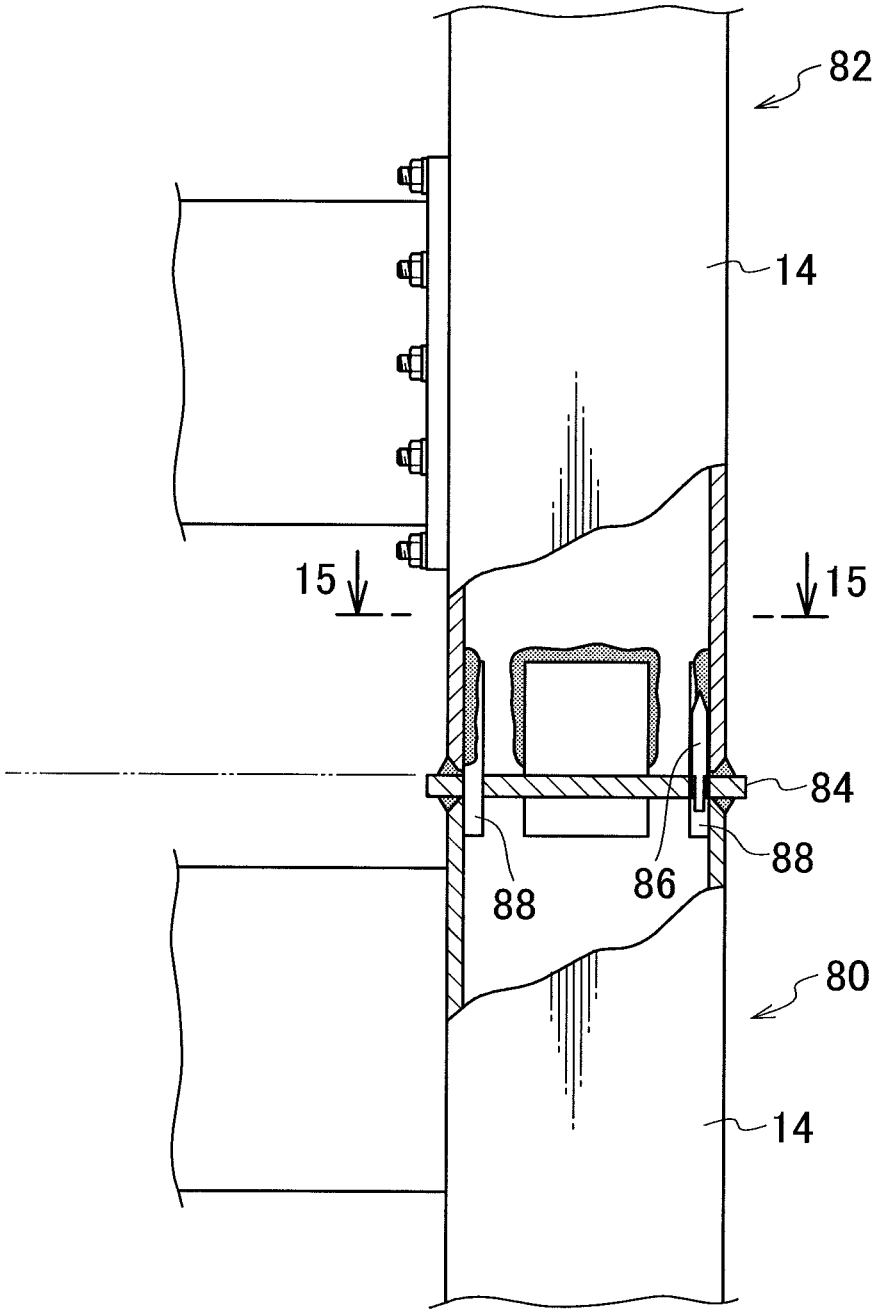
FIG. 14 is an enlarged side view of an essential part showing a connection structure of column members of the lower floor and the upper floor.
Figure 15:
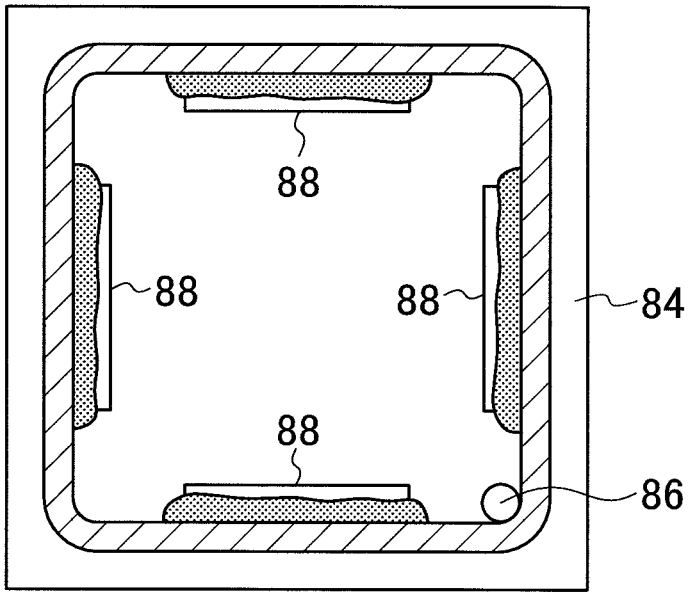
FIG. 15 is a sectional view of the column member taken along the 15-15 line of FIG. 14.

In this case, as shown in the enlarged view of the essential part of FIG. 14, a rectangular flange 84 is welded onto the upper portion of the column member 14 of the room module 10 on the lower floor 80, and a guide rod 86 is mounted to one of four corners of the flange 84, as shown in FIG. 15. Subsequently, four load support plates 88 are fixedly attached to four sides of the lower portion of the column member 14 of the room module 10 on the upper floor 82, in the vertical direction, and with the guide rod 86 used as a guide, the column member 14 of the upper floor 82 and the column member 14 of the lower floor 80 are positioned on the same axis. Thereafter, the flange 84 and the column member 14 of the upper floor 82 are preferably welded to each other. Thereby, on-site installation can be facilitated.

Next, the features of the building construction method and the room module 10 of the embodiment will be described.

First, the room module 10 of the embodiment can be manufactured with much higher precision than building construction, by using a variable standard jig in a plant, and therefore, manufacture of the modules with high percentage of completion which cannot be attained by the conventional module is enabled.

The maximum mass of the room module 10 is determined in consideration of plant manufacturing, transportation and installation, and the room modules 10 are transported to a construction site from the plant by using a large dolly, a barge, a large crane and the like to be installed.

Figure 16:
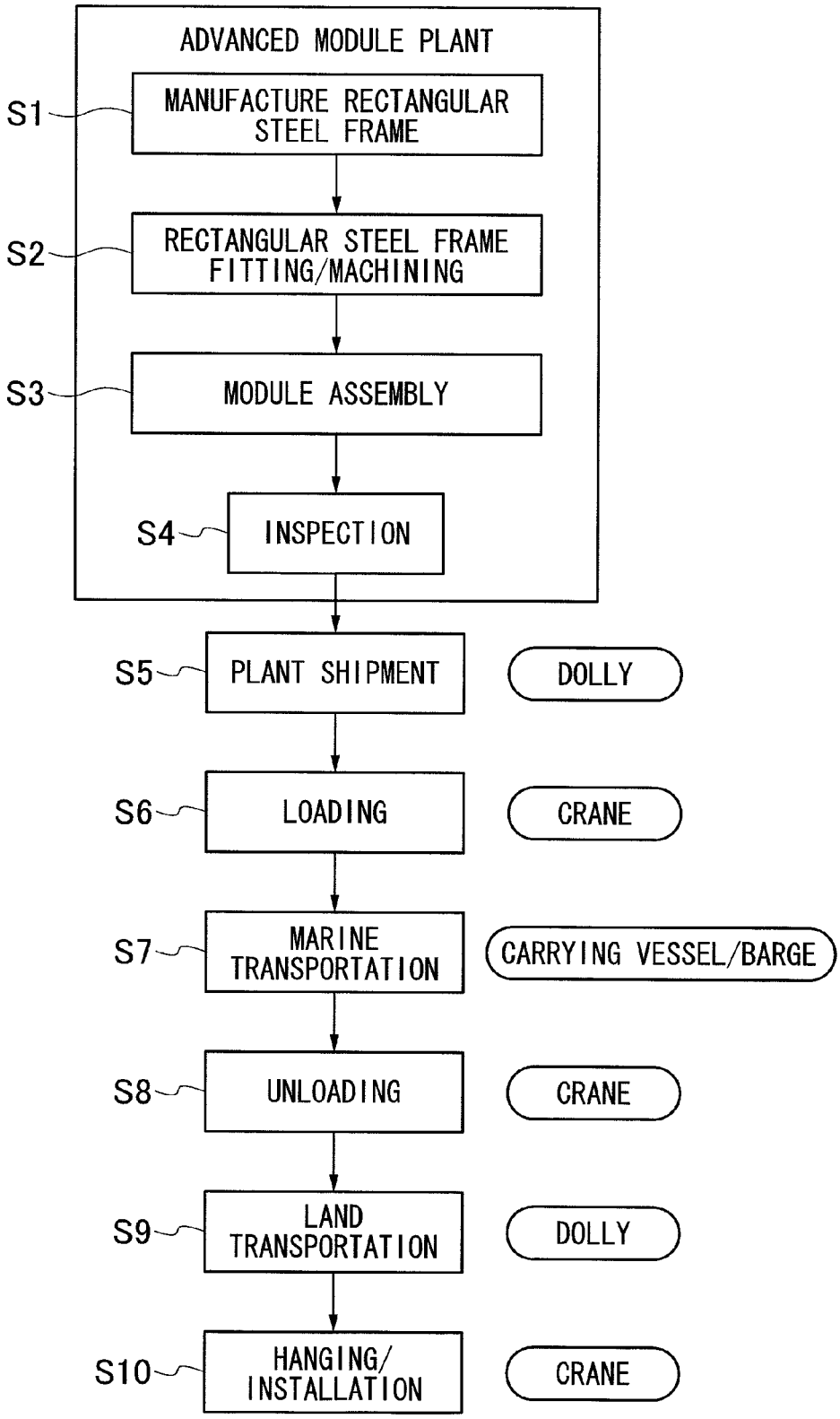
FIG. 16 is a flowchart from manufacture to installation of the room module.

More specifically, as shown in a flowchart of FIG. 16, in the construction the room module 10, a rectangular steel frame is firstly manufactured in a manufacture plant of the room module 10 (S (Step) 1). Next, the rectangular steel frame is assembled, and machining is carried out to obtain dimensional precision (S2). Next, the mechatronics equipment is incorporated into the rectangular steel frame to produce the room module 10 (S3), and thereafter, inspection is carried out to complete the room module 10 (S4). Further, painting is also preferably carried out in the plant.

Next, as to the method for shipping and transporting the room module 10 to a construction site from the plant, first, a dolly is used from the plant to shipping (S5), a crane is used for shipping (S6), and a carrying vessel or a barge is used for marine transportation (S7). Subsequently, the room module 1-is unloaded with a crane (S8), after which, a dolly is used for transportation by land (S9), and the room module 10 is installed on the construction site by using a crane or the like (S10).

Figure 17:
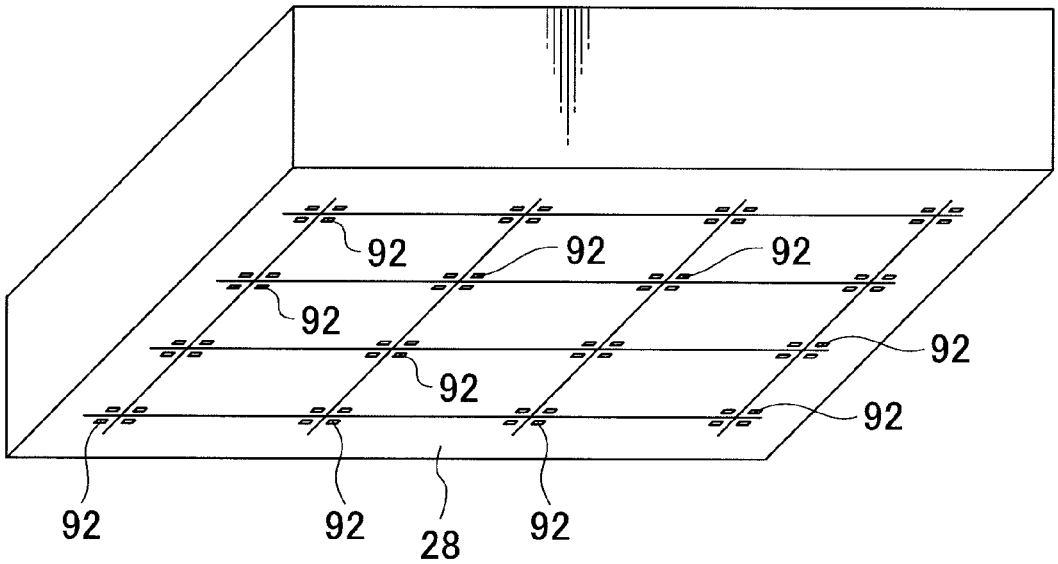
FIG. 17 is a perspective view showing a floor surface of a building.
Figure 18:
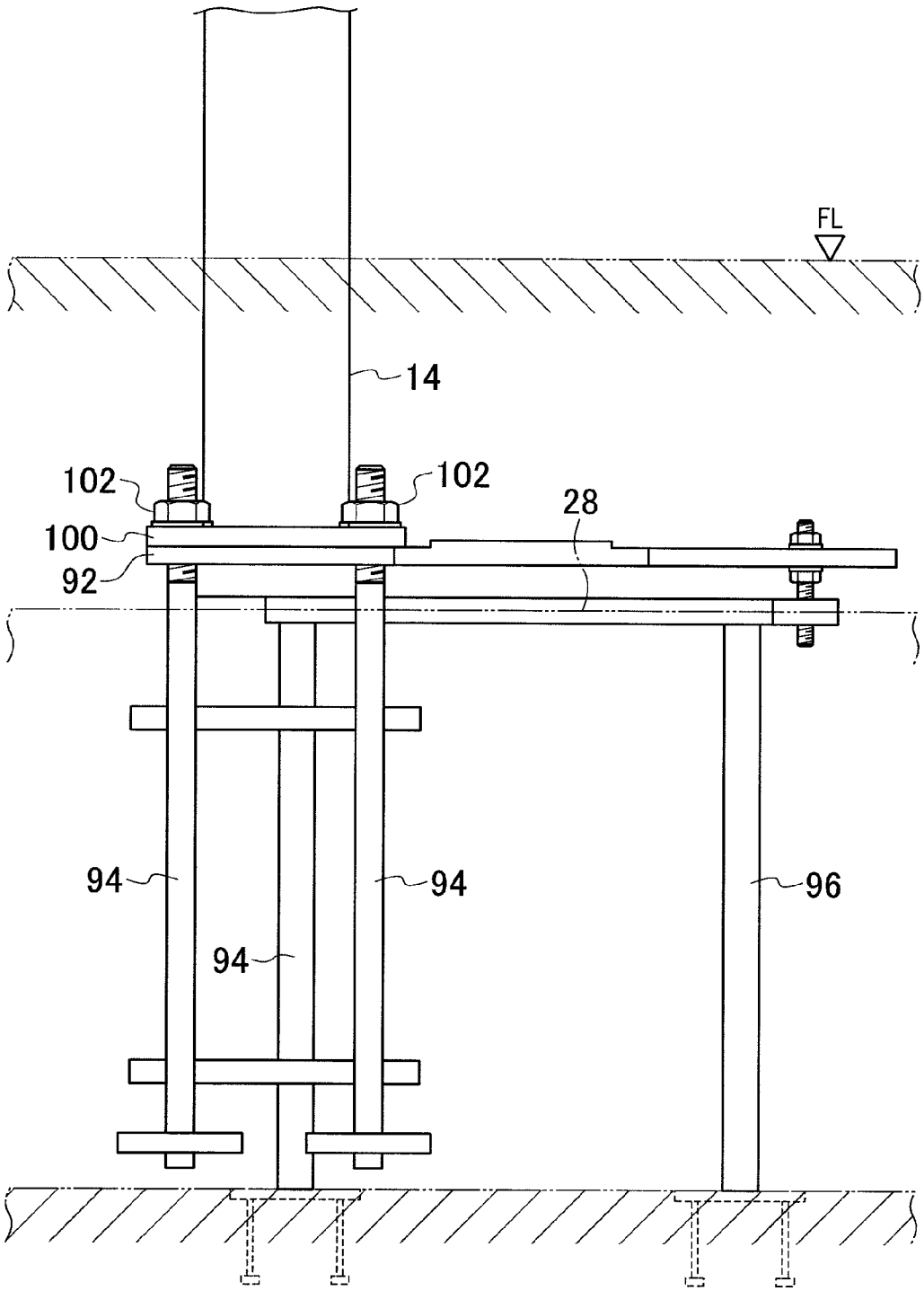
FIG. 18 is a side view showing a foundation structure of the building.

At the site, as shown in FIG. 17, the floor surface 28 on which the room modules 10 are installed is established as an artificial rock base, and on the floor surface 28, base plates 92 on which the column members 14 of the room modules 10 are placed are provided. In the side view of the foundation structure shown in FIG. 18, the base plate 92 is supported by a plurality of anchor bolts 94, and is also supported by a support frame 96 for bracing. The column member 14 of the room module 10 which is placed on the base plate 92 is fixed to the base plate 92 by butting flange 100 which is fixed to the lower portion of the column member 14 with the base plate 92 and fixing with nuts 102. Thereby, the room modules 10 are installed on the floor surface 28, and the first floor portion (lower floor 80) of the building is constructed as shown in FIG. 7. Further, at the same time as this, the frame column 12 on the first floor portion is also constructed by the aforementioned method. Furthermore, an operation of connecting the mechatronics equipment placed in each of the room modules 10 to the mechatronics equipment of the adjacent room modules 10 is performed, and thereafter, concrete is placed on the ceiling of the room modules 10. Thereby, construction of the first floor portion of the building is completed.

Further, as to connection of the room modules 10 on the construction site, the lateral beams 16, the column members 14, the steel plates 22 and the like are fixed by welding or the like. Further, after installation of the room module 10, concrete is charged into the spaces between the respective column members 14 and the beams 16 of the angular steel pipe. On this occasion, since the deck plate 20, the reinforcing steel 18 and the buried matters are substantially incorporated in the room module 10 in the plant, and therefore, the construction period can be shortened. The concrete may be partially charged in the plant. Furthermore, connection of the sleeves between walls is carried out by the outer casing for connection before charging the concrete.

When the construction of the first floor portion of the building is completed, the second floor portion is constructed by using the room modules 10 as shown in FIG. 13. In this case, the work similar to that of the first floor portion is carried out.

Figure 19:
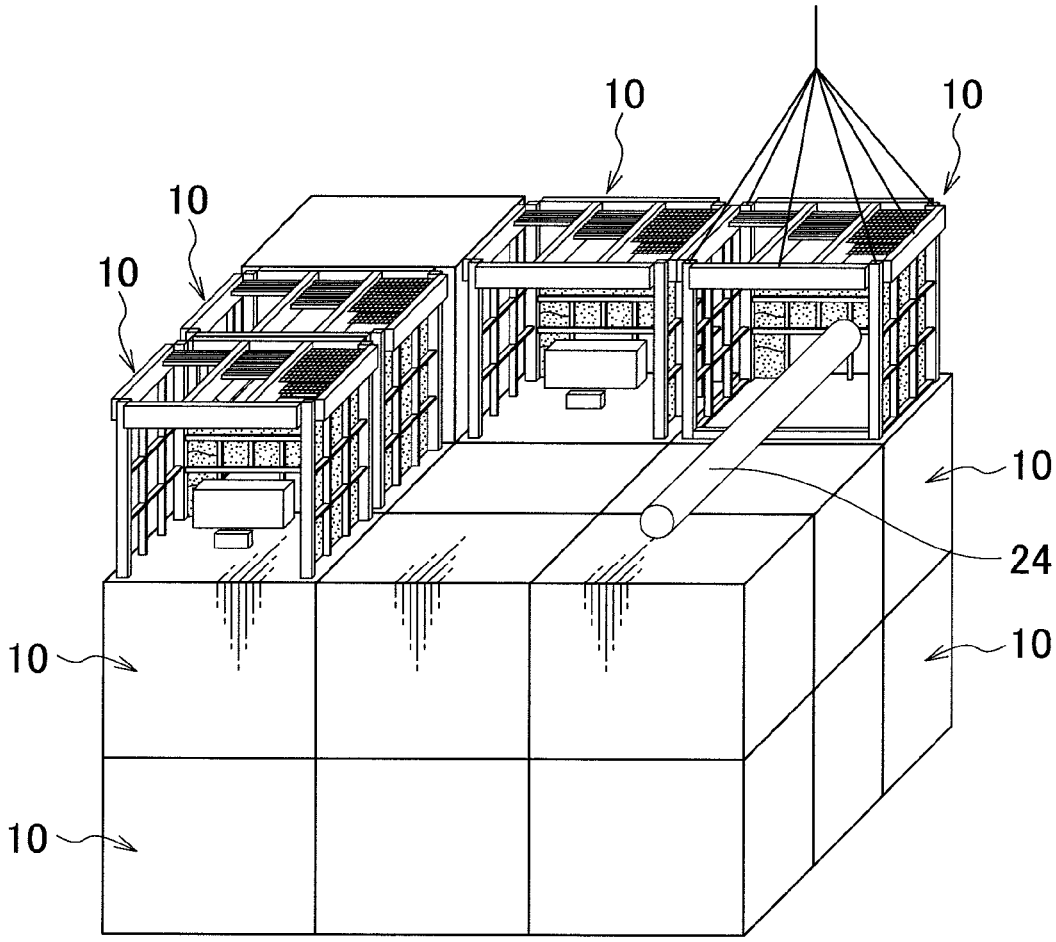
FIG. 19 is a perspective view showing an example of constructing a third floor portion of the nuclear power station building.

When the construction of the second floor portion is completed, the third floor portion is constructed by using the similar room modules 10 as shown in FIG. 19. In the area having a long device, and a long and large-diameter pipe 24, the steel frame configuration of the room module 10 of this place is preferably such that a joint is provided between a lower column of an upper floor beam and a raised upper surface column of a lower wall. Further, the long device and the long and large-diameter pipe 24 may be placed by manufacturing the room module 10 which can house the long device and the long and large-diameter pipe 24 and extends over a plurality of bocks by using the column members 14 which have the heights lower than that of the ordinary column member 14, and placing room modules 10 of ordinary span on that room module 10 so as to be added to that room module 10.

Figure 20:
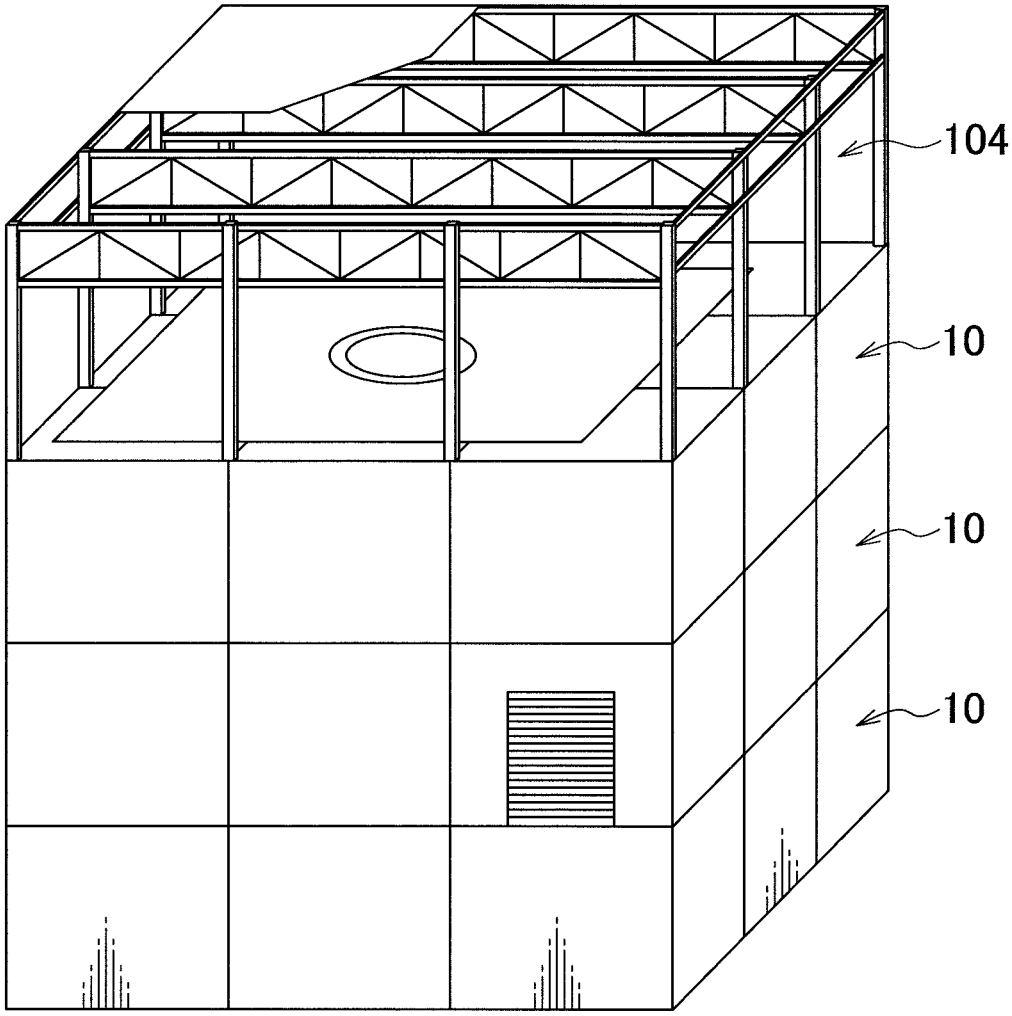
FIG. 20 is a perspective view showing an example of constructing an operation floor of the nuclear power station building.
Figure 21:
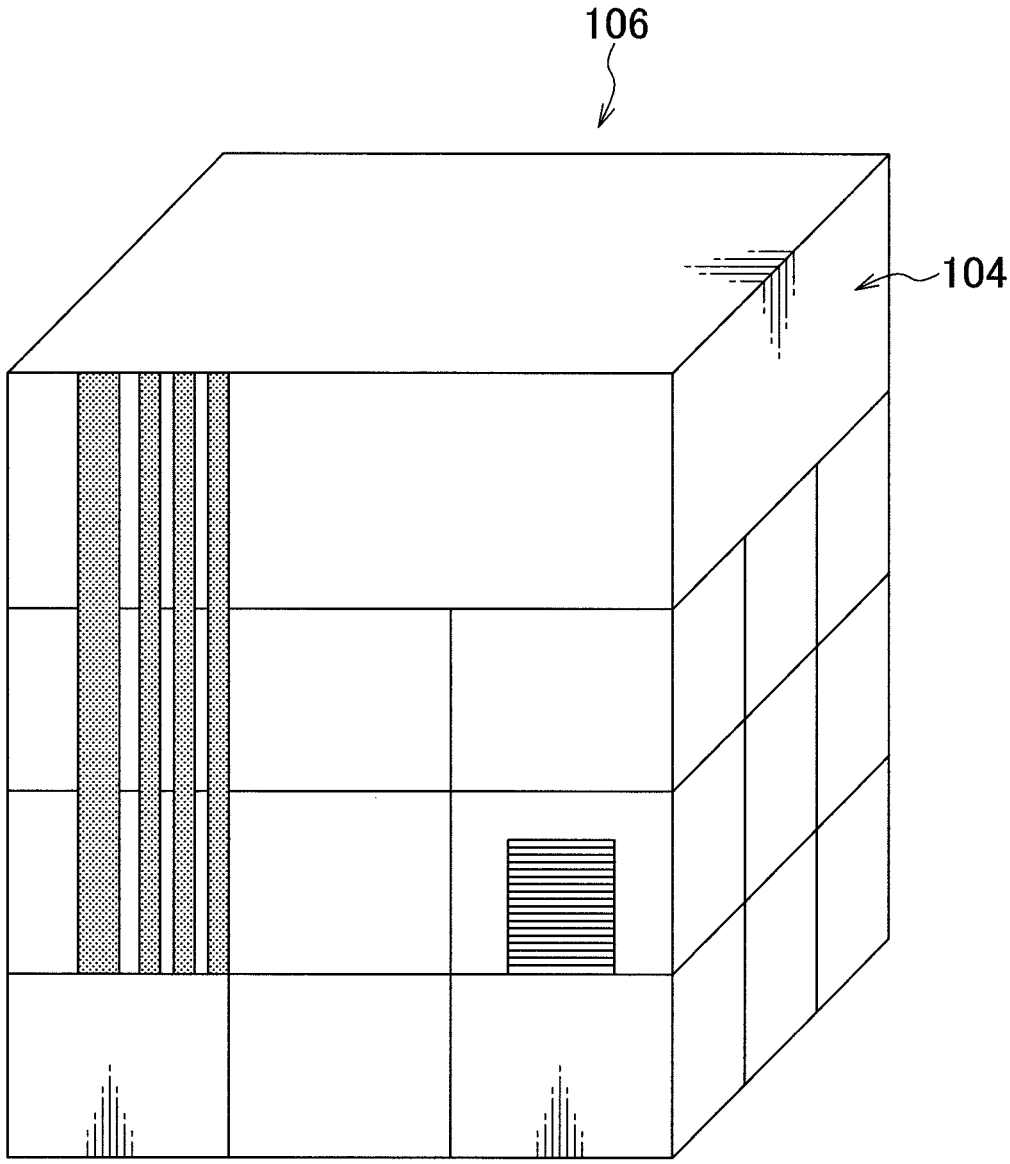
FIG. 21 is a general perspective view of a completed nuclear power station building.

When the construction of the third floor portion is completed, the fourth floor portion which is an operation floor 104 is constructed with a steel frame ceiling truss structure, as shown in FIG. 20. Thereafter, as shown in FIG. 21, the building outer wall construction and the mechatronics construction of the operation floor 104 are performed. Thereby, a nuclear power station building 106 is completed.

When the separate column member 14 is adopted, the column members 14 are connected to each other with temporary beams which are easily removed so as to form a rectangular steel frame configuration. The beams are mounted at the time of manufacture in the plant, and are removed after the room module 10 is installed on the site.

Figure 22:
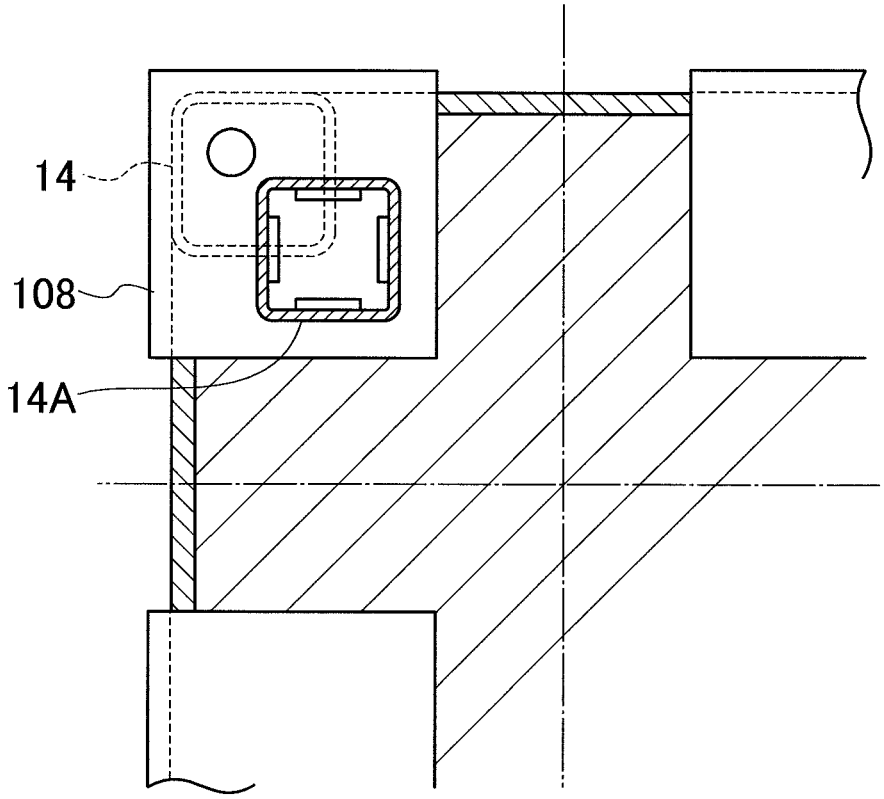
FIG. 22 is a plane view showing a connection structure of the column members of the lower floor and the upper floor with different column cross-sections.

Further, since the column section is reduced toward the upper floor, if the sections of the frame columns 12 of the room module 10 on the lower floor layer and the room module 10 on the upper floor layer differ from each other, a modified flange 108 is welded to an upper end portion of the column member 14 of the room module 10 on the lower floor layer as shown in FIG. 22, and a column member 14A of the room module 10 on the upper floor layer is welded onto a top surface of the modified flange 108, whereby the frame columns 12 can be joined to each other.

From the above, according to the building construction method and the room module 10 of the embodiment, the following effects can be obtained:

a) Modularization range can be enlarged, and reduction in the number of workers and the construction period can be realized by reducing on-site working amount. Especially in foreign countries, simplification of infrastructures and management of local constructors can be realized.

b) In-plant manufacture enables quality maintenance and highly efficient production, and maintenance and concentration of overall technical expertise, quality improvement and cost reduction can be realized.

c) Because of the steel frame structure, design of equipment and facilities is enabled without being influenced by the concrete building finished dimensions, and the design cost is reduced. Further, the on-site adjustment operation can be significantly reduced.

d) In the on-site product management, the management operation of component receiving, storage, delivery and the like can be significantly reduced.

e) By the above description, the total cost relating to building construction can be reduced.

What is claimed is:

1. A building construction method for constructing a building, comprising:

manufacturing, in a plant, a plurality of rectangular room modules, each with a steel frame structure, including the following steps:

connecting beams into a rectangular steel frame, to create a ceiling frame of a rectangular room module, connecting a frame column member to each corner of the ceiling frame, connecting vertical column members to the ceiling frame, wherein said vertical column members do not include said frame column members, connecting beams between vertical column members, between frame column members, and between frame column members and vertical column members, so as to create walls of the rectangular room module, fitting steel plates in empty spaces in the walls of the rectangular room module, each empty space in a wall being framed by: beams, and either two vertical column members, or a vertical column member and a frame column member, rotating the rectangular room module so as to dispose the ceiling frame of the rectangular room module above the walls of the rectangular room module, fitting a deck plate or a reinforcing steel member in each empty space in the ceiling of the rectangular room module, each empty space in the ceiling being framed by beams, and placing mechatronics equipment in rectangular room modules, said mechatronics equipment including at least one of: piping, ducts and cables;

transporting the rectangular room modules from the plant to a building construction site;

installing the rectangular room modules in a grid pattern, including creating a frame column of the building by connecting four frame column members adjacent to one another, wherein each frame column member is from a different rectangular room module, and wherein each frame column member is vertically provided at a corner of one of a plurality of adjacent rectangular room modules;

placing concrete on the ceiling of a rectangular room module, thereby enabling the ceiling of the rectangular room module to act as a floor surface of another rectangular room module installed thereon; and placing concrete in a space in a rectangular parallelepiped shape, which is longer in a vertical direction than in any other direction, the rectangular parallelepiped shape formed by connecting adjacent frame column members with steel plates so as to make the frame columns of the building have a steel plate concrete structure.

2. The building construction method according to claim 1, further comprising:

forming a steel plate concrete structure wall or a reinforced concrete structure wall in a space between walls of adjacent rectangular room modules.

3. The building construction method according to claim 1, wherein at least one die steel member is disposed between column members at a same plane as a wall surface of the rectangular room module, or parallel to beam members of the rectangular room module at a same plane as a ceiling; and wherein said at least one die steel member is used as a support member configured to support mechatronics equipment welded thereupon.

4. The building construction method according to claim 1, further comprising:

when an upper floor layer is constructed by installing, on a lower floor layer of the building, a rectangular room module having a same configuration as a plurality of rectangular room modules constituting the lower floor layer, joining, by welding, a lower portion of the column member of the rectangular room module on the upper floor layer and an upper portion of the column member of the rectangular room module on the lower floor layer.

5. A rectangular room module, created in the building construction method according to claim 1.

6. The building construction method according to claim 1, wherein said mechatronics equipment includes power station equipment.

7. A building construction method for constructing a building, comprising:

manufacturing, in a plant, a plurality of room modules, each room module manufactured with a steel frame structure, as follows:

connecting beams into a steel frame, the steel frame used as a ceiling frame of a room module, connecting a frame column member to each corner of the ceiling frame, connecting vertical column members to the ceiling frame, wherein said vertical column members do not include said frame column members, connecting beams between vertical column members, between frame column members, and between frame column members and vertical column members, so as to create walls of the room module, connecting steel plates to frames of empty spaces in the walls of the room module, each frame of an empty space including: beams, and either two vertical column members, or a vertical column member and a frame column member, turning the room module upside down, so as to dispose the ceiling frame of the room module above the walls of the room module, fitting a deck plate or a reinforcing steel member in each empty space in the ceiling of the room module framed by beams, and placing mechatronics equipment in the rectangular room modules, said mechatronics equipment including any of: piping, ducts and cables;

transporting the room modules from the plant to a building construction site;

placing concrete on a ceiling of a room module, thereby creating a concrete surface that enables said ceiling of a room module to act as floor surface of another room module installed thereon;

installing the room modules in a three-dimensional (3D) grid pattern, including creating a frame column of the building by connecting four frame column members adjacent to one another, wherein each frame column member is from a different rectangular room module, and wherein each frame column member is vertically provided at a corner of one of a plurality of adjacent room modules; and placing concrete in a space in a rectangular parallelepiped shape, which is longer in a vertical direction than in any other direction, the rectangular parallelepiped shape formed by connecting adjacent frame column members with steel plates so as to make the frame columns of the building have a steel plate concrete structure.

8. The building construction method according to claim 7, further comprising:

forming a steel plate concrete structure wall or a reinforced concrete structure wall in a space between walls of adjacent room modules.

9. The building construction method according to claim 7, wherein at least one die steel member is disposed parallel to column members at a same plane as a wall surface of the room module, or parallel to beam members of the room module at a same plane as a ceiling; and wherein said at least one die steel member is used as a support member configured to support mechatronics equipment welded thereupon.

10. The building construction method according to claim 7, further comprising:

when an upper floor layer is constructed by installing, on a lower floor layer of the building, a room module having a same configuration as a plurality of room modules constituting the lower floor layer, joining, by welding, a lower portion of the column member of the room module on the upper floor layer and an upper portion of the column member of the room module on the lower floor layer.

11. A room module, created in the building construction method according to claim 7.

12. The building construction method according to claim 7, wherein said mechatronics equipment includes power station equipment.

13. A building construction method for constructing a building, comprising:

manufacturing, in a plant, a plurality of rectangular room modules, each with a steel frame structure, including the following steps:

connecting beams into a rectangular steel frame, to create a ceiling frame of a rectangular room module, connecting a frame column member to each corner of the ceiling frame, connecting vertical column members to the ceiling frame, wherein said vertical column members do not include said frame column members, connecting beams between vertical column members, between frame column members, and between frame column members and vertical column members, so as to create walls of the rectangular room module, fitting steel plates in empty spaces in the walls of the rectangular room module, each empty space in a wall being framed by: beams, and either two vertical column members, or a vertical column member and a frame column member, rotating the rectangular room module so as to dispose the ceiling frame of the rectangular room module above the walls of the rectangular room module, fitting a deck plate or a reinforcing steel member in each empty space in the ceiling of the rectangular room module, each empty space in the ceiling being framed by beams, and placing mechatronics equipment in rectangular room modules, said mechatronics equipment including at least one of: piping, ducts and cables;

transporting the rectangular room modules from the plant to a building construction site;

installing the rectangular room modules in a grid pattern, including creating a frame column of the building by connecting four frame column members adjacent to one another, wherein each frame column member is from a different rectangular room module, and wherein each frame column member is vertically provided at a corner of one of a plurality of adjacent rectangular room modules;

placing concrete on the ceiling of a rectangular room module, thereby enabling the ceiling of the rectangular room module to act as a floor surface of another rectangular room module installed thereon;

placing a reinforcing steel member in a space in a rectangular parallelepiped shape, which is longer in a vertical direction than in any other direction, the rectangular parallelepiped shape formed by connecting adjacent frame column members with steel plates; and placing concrete in the space so as to make the frame columns of the building have a reinforced concrete structure.

14. A building construction method for constructing a building, comprising:

manufacturing, in a plant, a plurality of room modules, each room module manufactured with a steel frame structure, as follows:

connecting beams into a steel frame, the steel frame used as a ceiling frame of a room module, connecting a frame column member to each corner of the ceiling frame, connecting vertical column members to the ceiling frame, wherein said vertical column members do not include said frame column members, connecting beams between vertical column members, between frame column members, and between frame column members and vertical column members, so as to create walls of the room module, connecting steel plates to frames of empty spaces in the walls of the room module, each frame of an empty space including: beams, and either two vertical column members, or a vertical column member and a frame column member, turning the room module upside down, so as to dispose the ceiling frame of the room module above the walls of the room module, fitting a deck plate or a reinforcing steel member in each empty space in the ceiling of the room module framed by beams, and placing mechatronics equipment in the rectangular room modules, said mechatronics equipment including any of: piping, ducts and cables;

transporting the room modules from the plant to a building construction site;

placing concrete on a ceiling of a room module, thereby creating a concrete surface that enables said ceiling of a room module to act as floor surface of another room module installed thereon;

installing the room modules in a three-dimensional (3D) grid pattern, including creating a frame column of the building by connecting four frame column members adjacent to one another, wherein each frame column member is from a different rectangular room module, and wherein each frame column member is vertically provided at a corner of one of a plurality of adjacent room modules;

placing a reinforcing steel member in a space in a rectangular parallelepiped shape, which is longer in a vertical direction than in any other direction, the rectangular parallelepiped shape formed by connecting adjacent frame column members with steel plates; and placing concrete in the space so as to make the frame columns of the building have a reinforced concrete structure.

* * * * *